US007461578B2

(12) United States Patent
Tamura et al.

(10) Patent No.: US 7,461,578 B2
(45) Date of Patent: Dec. 9, 2008

(54) PERFORATOR FOR IMAGING APPARATUS, AND PAPER HANDLER PROVIDED THEREWITH

(75) Inventors: Masahiro Tamura, Tokyo (JP); Nobuyoshi Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 251 days.

(21) Appl. No.: 10/901,049

(22) Filed: Jul. 29, 2004

(65) Prior Publication Data

US 2005/0061131 A1 Mar. 24, 2005

(30) Foreign Application Priority Data

Aug. 1, 2003 (JP) ..... 2003-285274
May 25, 2004 (JP) ..... 2004-154894

(51) Int. Cl.
*B26D 7/18* (2006.01)
*G03G 15/00* (2006.01)

(52) U.S. Cl. ..... 83/147; 83/149; 83/165; 83/167; 83/691; 399/407

(58) Field of Classification Search ..... 83/681, 83/691, 147, 149, 684–689, 165–168, 157; 241/100; 399/407, 621; *B41J 11/70*
See application file for complete search history.

(56) References Cited

U.S. PATENT DOCUMENTS 3,175,443 A 3/1965 Kettnich et al.
4,650,128 A * 3/1987 Goldhammer ..... 241/36
5,186,299 A * 2/1993 Stimson ..... 193/2 R
5,692,411 A 12/1997 Tamura
5,793,298 A 8/1998 Matsuura
6,145,825 A 11/2000 Kunihiro et al.

(Continued)

FOREIGN PATENT DOCUMENTS

EP 1 038 642 A2 9/2000

(Continued)

OTHER PUBLICATIONS

U.S. Appl. No. 11/223,052, filed Sep. 12, 2005, Suzuki, et al.

(Continued)

*Primary Examiner*—Boyer D. Ashley
*Assistant Examiner*—Phong Nguyen
(74) *Attorney, Agent, or Firm*—Oblon, Spivak, McClelland, Maier & Neustadt, P.C.

(57) ABSTRACT

A perforator includes a perforating unit, a chad recovery/delivery unit, a chad storage unit, a chad guiding unit, and a shielding unit. The perforating unit perforates a sheet-shaped recording medium. The chad recovery/delivery unit delivers a chad perforated by the perforating unit to the chad storage unit via discharge channels in the chad guiding unit. The chad storage unit stores the delivered chad. The shielding unit includes a shielding body and a shielding face fixed on an end thereof. The shielding unit releases a shielding against the discharge channels to discharge the chad though an opening in an interior of the shielding body to the chad storage unit when the shielding unit is in a first position. When the shielding unit is in a second position, the shielding face blocks the discharge channels to prevent the chad from being discharged to the chad storage unit.

43 Claims, 23 Drawing Sheets

U.S. PATENT DOCUMENTS

| | | | |
|---|---|---|---|
| 6,199,853 | B1 | 3/2001 | Andoh et al. |
| 6,253,057 | B1 | 6/2001 | Yamanaka |
| 6,264,191 | B1 | 7/2001 | Suzuki et al. |
| 6,296,247 | B1 | 10/2001 | Tamura et al. |
| 6,394,448 | B2 | 5/2002 | Suzuki et al. |
| 6,494,449 | B2 | 12/2002 | Tamura et al. |
| 6,494,453 | B1 | 12/2002 | Yamada et al. |
| 6,527,269 | B2 | 3/2003 | Yamada et al. |
| 6,549,734 | B2 | 4/2003 | Yamada et al. |
| 6,698,744 | B2 | 3/2004 | Yamada et al. |
| 6,783,124 | B2 | 8/2004 | Tamura et al. |
| 2002/0063380 | A1 | 5/2002 | Tamura et al. |
| 2002/0079642 | A1 | 6/2002 | Tamura et al. |
| 2002/0135119 | A1 | 9/2002 | Suzuki et al. |
| 2002/0158405 | A1 | 10/2002 | Nagasako et al. |
| 2003/0006543 | A1 | 1/2003 | Tamura et al. |
| 2003/0057641 | A1 | 3/2003 | Yamada et al. |
| 2003/0151187 | A1 | 8/2003 | Suzuki et al. |
| 2003/0160376 | A1 | 8/2003 | Yamada et al. |
| 2003/0215275 | A1 | 11/2003 | Tamura et al. |
| 2003/0219295 | A1 | 11/2003 | Saitoh et al. |
| 2003/0234487 | A1 | 12/2003 | Tamura et al. |
| 2004/0070133 | A1 | 4/2004 | Yamada et al. |
| 2004/0104525 | A1 | 6/2004 | Suzuki et al. |
| 2005/0061131 | A1 | 3/2005 | Tamura et al. |

FOREIGN PATENT DOCUMENTS

| | | | |
|---|---|---|---|
| JP | 1-146696 | | 6/1989 |
| JP | 11-139674 | * | 5/1999 |

OTHER PUBLICATIONS

U.S. Appl. No. 11/254,868, filed Oct. 21, 2005, Suzuki et al.
U.S. Appl. No. 11/267,403, filed Nov. 7, 2005, Tokita et al.
U.S. Appl. No. 11/273,301, filed Nov. 15, 2005, Iida et al.

* cited by examiner

PERFORATOR FOR IMAGING APPARATUS, AND PAPER HANDLER PROVIDED THEREWITH

BACKGROUND OF THE INVENTION

1. Field of the Invention

The present invention relates to a perforator for perforating a sheet-shaped recording medium, for example, paper; a paper handler that includes the perforator; and an imaging apparatus comprising the perforator or the paper handler, such as copy machine, fax machine, printer, or a combination of these. The present invention particularly relates to a perforator, paper handler, and imaging apparatus having a recovery mechanism for the chad after perforating.

2. Description of the Background Art

Paper finishers as paper handlers, and imaging apparatuses provided integrally or separately with these paper finishers include those that are provided with a perforator for perforating a sheet-shaped recording medium (hereinafter referred to as paper). In an apparatus provided with such a perforator, the main body of the imaging apparatus forms an image and the discharged paper is perforated by the perforator, then the paper is either discharged in unaltered form into a catch tray (discharged loading part), or delivered to a paper finisher for assorting, filing, or stacking.

Such a perforator includes a punch and die for opening holes in the paper, a punch chad delivery device for delivering the punch chad created when the punch and die open holes in the paper, and a punch chad box (hopper) for collecting the punch chad delivered by the punch chad delivery device. An example of such a perforator is disclosed in Japanese Laid-Open Patent Application Nos. 2001-25995, 7-112861, and 6-155393, for example.

In the perforator disclosed in Japanese Laid-Open Patent Application No. 2001-25995, the punch chad delivery device employs a screw-type delivery device, and is configured such that the punch chad box is detachably provided to the outer side of the main body of the imaging apparatus. The punch chad delivery device stops being driven when the punch chad box is removed from the main body of the imaging apparatus, but the image forming operation of the imaging apparatus continues. This conventional perforator is thereby designed such that the punch chad is not dispersed as waste to the exterior of the device.

Also, in the perforator disclosed in Japanese Laid-Open Patent Application No. 7-112861, the device for storing the chad during the perforation process is configured such that a punch chad receptacle can be detached from the imaging apparatus exterior via an opening formed in a side panel on the main body of the imaging apparatus, and is also configured such that forming the punch chad receptacle with transparent plastic or another such material allows the punch chad receptacle interior to be visible from outside the apparatus. The punch chad receptacle is also disposed on the side of the main body of the imaging apparatus, so punch chad can be easily processed from the exterior.

Furthermore, in the perforator disclosed in Japanese Laid-Open Patent Application No. 6-155393, the punch mechanism is mounted on an opening and closing cover provided to the side of the copy machine main body, and a paper ejecting tank for storing punch chad created when punch holes are opened by the punch mechanism can be detached from the opening and closing cover.

However, with a conventional perforator described above, sometimes the chad after perforation falls into the interior of the device or is scattered to the device exterior. When the chad thus falls into the device interior or is scattered to the device exterior without being collected in a chad collecting box or the like, the chad may enter the portion in the device relating to imaging and hinder the imaging process, or may be scattered onto the floor on which the device is installed and have an adverse effect on the work area.

SUMMARY OF THE INVENTION

The present invention was designed in view of the circumstances with such conventional technology, and an object thereof is to provide a perforator whereby chad can be reliably prevented from falling and scattering into the device, a paper handler that includes this perforator, and various imaging apparatuses equipped therewith.

In an aspect of the present invention, a perforator comprises perforating means for perforating a sheet-shaped recording medium, chad recovery/delivery means for delivering the chad perforated by the perforating means, chad storage means for storing the chad delivered by the chad recovery/delivery means; and shielding means for shielding discharge channels whereby chad is discharged from the chad recovery/delivery means to the chad storage means.

In another aspect of the present invention, a paper handler comprises a perforator for perforating a sheet-shaped recording medium, and processing means for performing a predetermined process on the recording medium. The perforator comprises perforating means for perforating the recording medium, chad recovery/delivery means for delivering the chad perforated by the perforating means, chad storage means for storing the chad delivered by the chad recovery/delivery means, and shielding means for shielding discharge channels whereby chad is discharged from the chad recovery/delivery means to the chad storage means.

In another aspect of the present invention, an imaging apparatus integrally or separately comprises imaging means for forming an image on a recording medium, and a perforator for perforating the recording medium. The perforator comprises perforating means for perforating the recording medium, chad recovery/delivery means for delivering the chad perforated by the perforating means, chad storage means for storing the chad delivered by the chad recovery/delivery means, and shielding means for shielding discharge channels whereby chad is discharged from the chad recovery/delivery means to the chad storage means.

In another aspect of the present invention, an imaging apparatus integrally or separately comprises imaging means for forming an image on a recording medium, and a paper handler composed of a perforator for perforating the recording medium and processing means for performing a predetermined process on the recording medium. The perforator comprises perforating means for perforating the recording medium, chad recovery/delivery means for delivering the chad perforated by the perforating means, chad storage means for storing the chad delivered by the chad recovery/delivery means, and shielding means for shielding discharge channels whereby chad is discharged from the chad recovery/delivery means to the chad storage means.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Before describing the present invention, a conventional perforator and the problems therewith to be solved will be described.

Figure 23:
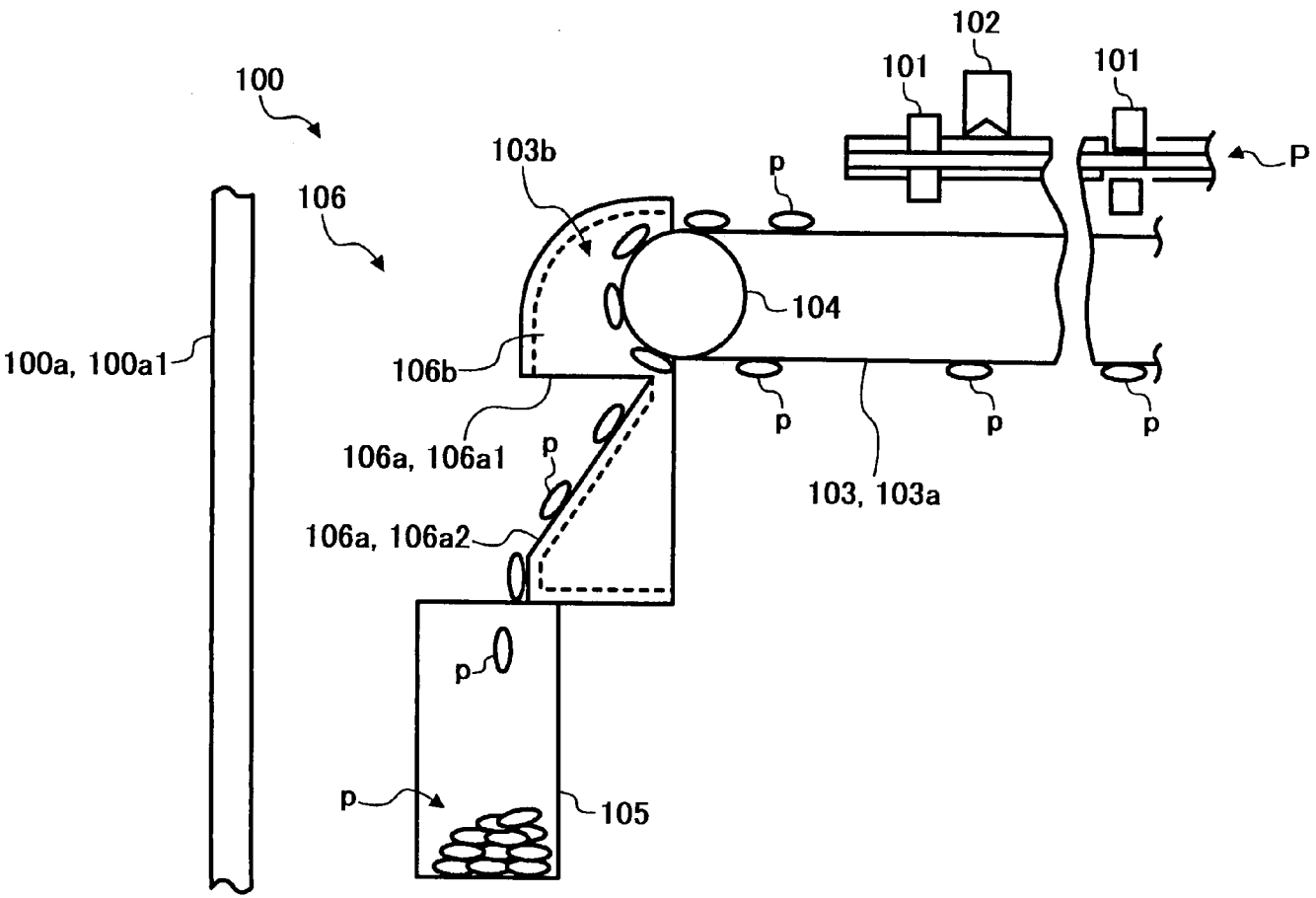
FIG. 23 PRIOR ART
FIG. 23 is an explanatory diagram for describing a conventional perforator.

The configuration of a conventional perforator is shown in FIG. 23. In this perforator 100, chad p, which is formed when paper P fed by a feed roller 101 in a direction orthogonal to the paper surface is perforated with a punch and a die by a perforating device 102, is loaded onto a feed belt 103*a* wound around a timing pulley 104 of a chad delivery device 103, and is delivered to the operating side of a front opening/closing door 100*a*1 in the main body front surface 100*a*. Most of the chad p separates from the feed belt 103*a* at the winding part 103*b* of the timing pulley 104 of the feed belt 103*a*, dropped via a guiding delivery opening 106*a*1 and a guiding delivery slide 106*a*2 of a guiding delivery route 106*a*, which constitute a chad guiding delivery device 106, and stored in a chad storage box 105.

However, the chad p after perforation sometimes carries static electricity, and sometimes paper fuzz is generated. In the case of such static electricity or paper fuzz, the chad p adheres to the feed belt 103*a* and sometimes does not separate from the feed belt 103*a* when traveling down the winding part 103*b*. When the chad p adheres to the feed belt 103*a* and does not fall to be stored in the chad storage box 105, the chad p moves around in unaltered form to the reverse side (underside) of the feed belt 103*a* from the winding part 103*b* as illustrated. Upon moving to the reverse side of the feed belt 103*a* in this manner, the chad p sometimes falls into the device interior or is scattered to the device exterior.

Thus, when the chad p is not stored in the chad storage box 105 but moves around to the reverse side of the feed belt 103*a* to be dropped into the device interior or scattered to the device exterior, the chad p sometimes blocks a reflective sensor or the like, and when the sensor for performing the detection necessary to imaging is blocked, errors sometimes occur in the detection or operation of the sensor, and the quality of the formed image is reduced as a result. Also, when a perforator is provided inside the main body of an imaging apparatus, chad sometimes is scattered in the apparatus and enters the portions involved in imaging, which hinders the imaging process.

Furthermore, when the front opening/closing door 100*a*1 of the front surface 100*a* is opened, the chad p still adhering to the middle or circumference of an internal hole 106*b* in the guiding delivery opening 106*a*1, the chad p that has fallen into the device interior due to wind pressure or the like, or the chad p scattered inside the apparatus sometimes flies outside of the apparatus and is scattered to the floor on which the apparatus is installed, which has an adverse effect on the work area.

In any case, when the front opening/closing door 100*a*1 is opened, or when the front opening/closing door 100*a*1 is closed with the chad storage box 105 still removed, and the perforating operation is performed, the chad p cannot be prevented from falling or scattering into the device interior.

The embodiments of the present invention designed to solve the problems with conventional technology described above will now be described in detail with reference to the diagrams.

In the following embodiments, the perforating device corresponds to the symbol 2; chad to the symbol p; the chad recovery/delivery device to the symbol 3; the chad storage device to the symbol 5 or a chad storage hopper 5*a*; the shielding device to a shielding member 7; the opening and closing member to the shielding member 7 or a shutter member 7*f*; the fulcrum to a fulcrum 7*e*; the shielding part to the symbol 7*a*; the through-hole part to the symbol 7*c*; the slide surface to a slanted surface section 7*c*1; the elastic urging device to a torsion spring 7*d*; the operating device to the chad storage hopper 5*a* or an operating part 10*b*; the opening and closing door to the symbol 0*a*1 or a front cover 10*a*1; the detection device to the symbol 9 or a range sensor 9*a*; the guiding device to a chad guide 6; the separating device to a chad separation accelerator 8, a pressing member 8*a*, or a peeling member 8*c*; the paper finisher to the symbol 10; and the imaging apparatus to the symbol 50.

First, the configuration and operation of a perforator relating to an embodiment of the present invention will be described with reference to FIGS. 1 through 5.

In these diagrams, a perforator 0 for perforating paper (sheet-shaped transfer medium, hereinafter referred to as paper) and recovering the resulting chad is composed of a feed device 1 for feeding the paper P from a feed opening 1*a* with a pair of feed rollers 1*b* in a direction orthogonal to the surface of the paper in FIG. 1; a punch 2*a* and die 2*b* constituting a perforating device 2 for perforating the paper P fed from the feed opening 1*a* and the feed rollers 1*b*; a delivery belt as a delivery member 3*a* wound around a pulley 3*b* and a pulley 3*c* constituting a chad recovery/delivery device 3 for recovering the chad p formed from the perforation of the punch 2*a* and die 2*b* and delivering the chad p to the operating side of an opening and closing door 0*a*1 in the main body front surface 0*a* (hereinafter referred to as an opening and closing door); a curved part 4 (curving delivery part) provided to the operating side of the opening and closing door 0*a*1 for separating the chad p delivered by the delivery member 3*a* from the delivery member 3*a*; a chad storage hopper 5*a* as a chad storage device 5 designed to store the chad p separated from the curved part 4 and to be detachable from the opening and closing door 0*a*1; a chad guide 6 for guiding the chad p that separates and falls from the curved part 4 into the chad storage hopper 5*a*; and a shielding part 7*a* of the shielding member 7 that is rotatably supported in the direction of shielding a guiding delivery opening 6*a*1 of a guiding delivery channel 6*a* for the chad p of the chad guide 6 when opened to attach or detach the Chad storage hopper 5*a*, and that is designed for shielding the chad delivery channel.

According to this configuration, the chad p can be prevented from falling or scattering into the apparatus, it is possible to store the chad reliably on the operating side of the opening and closing door 0*a*1, and errors in detection and operation can be prevented. Furthermore, since the chad p is prevented from falling or scattering, the apparatus has a clean appearance, is compact, and has superior operability without inducing deterioration in the surrounding area. This is described in detail below.

Figure 1:
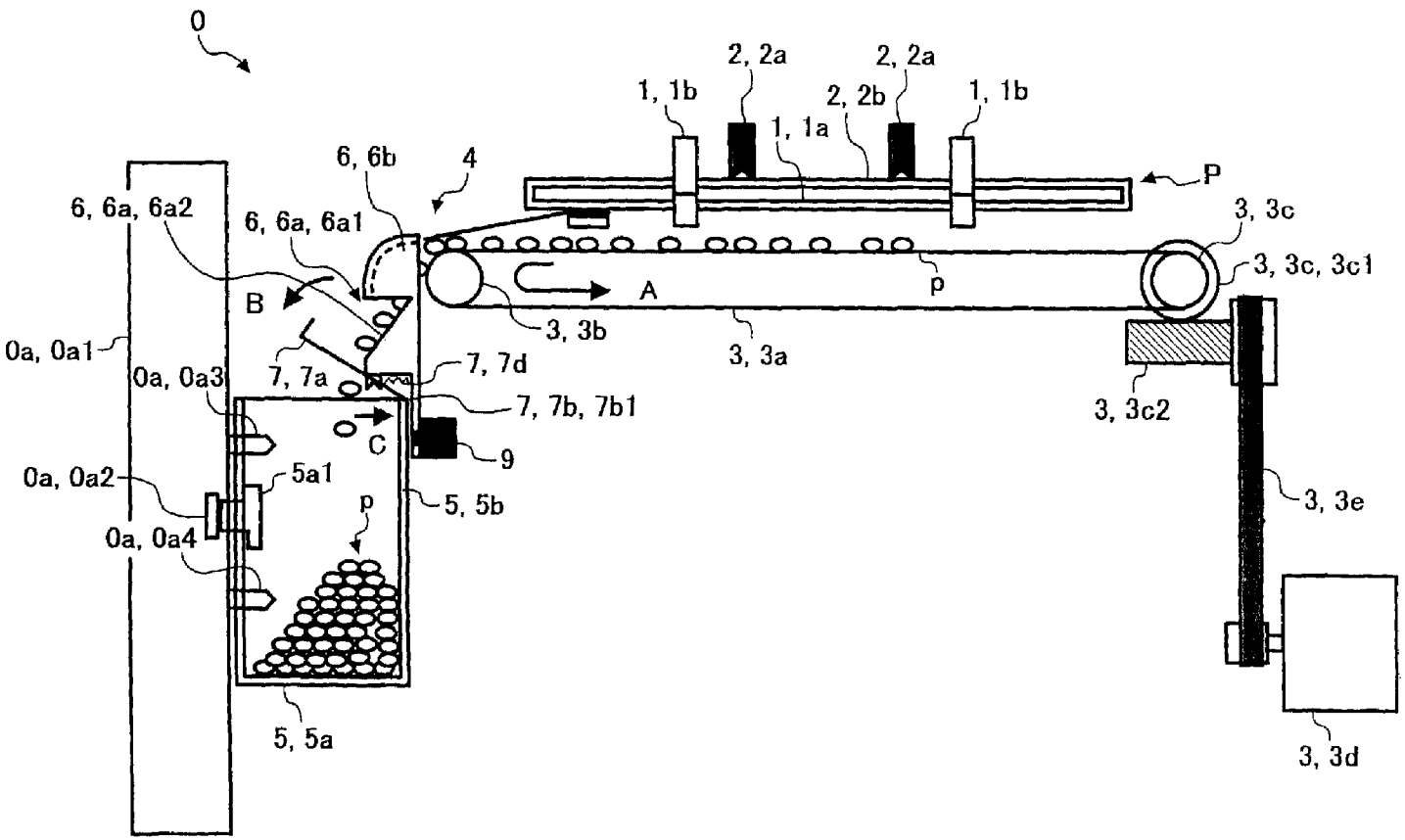
FIG. 1 is a diagram showing the schematic structure of a perforator relating to one embodiment of the present invention.
Figure 2:
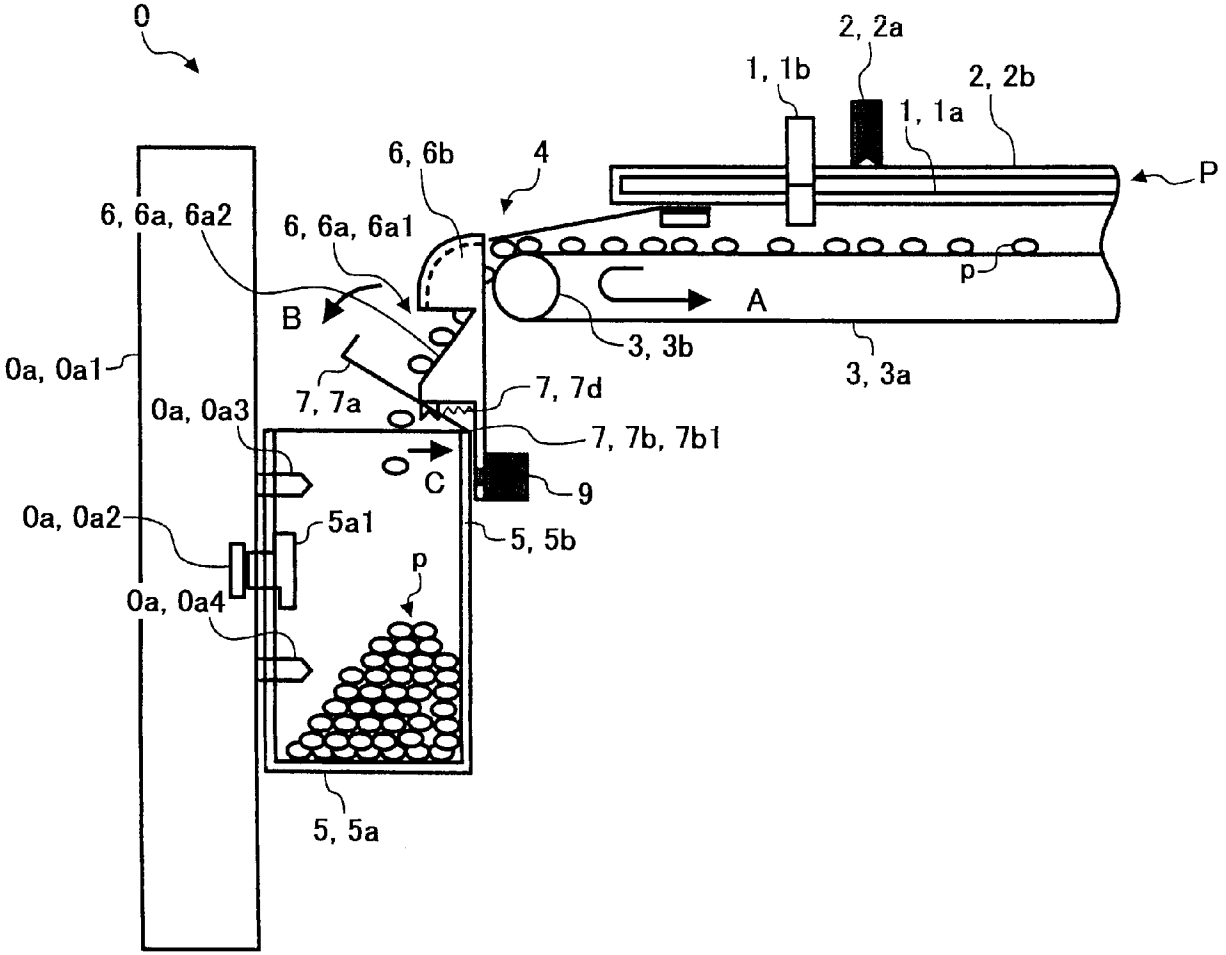
FIG. 2 is a diagram showing an enlarged view of the main section in FIG. 1.
Figure 5:
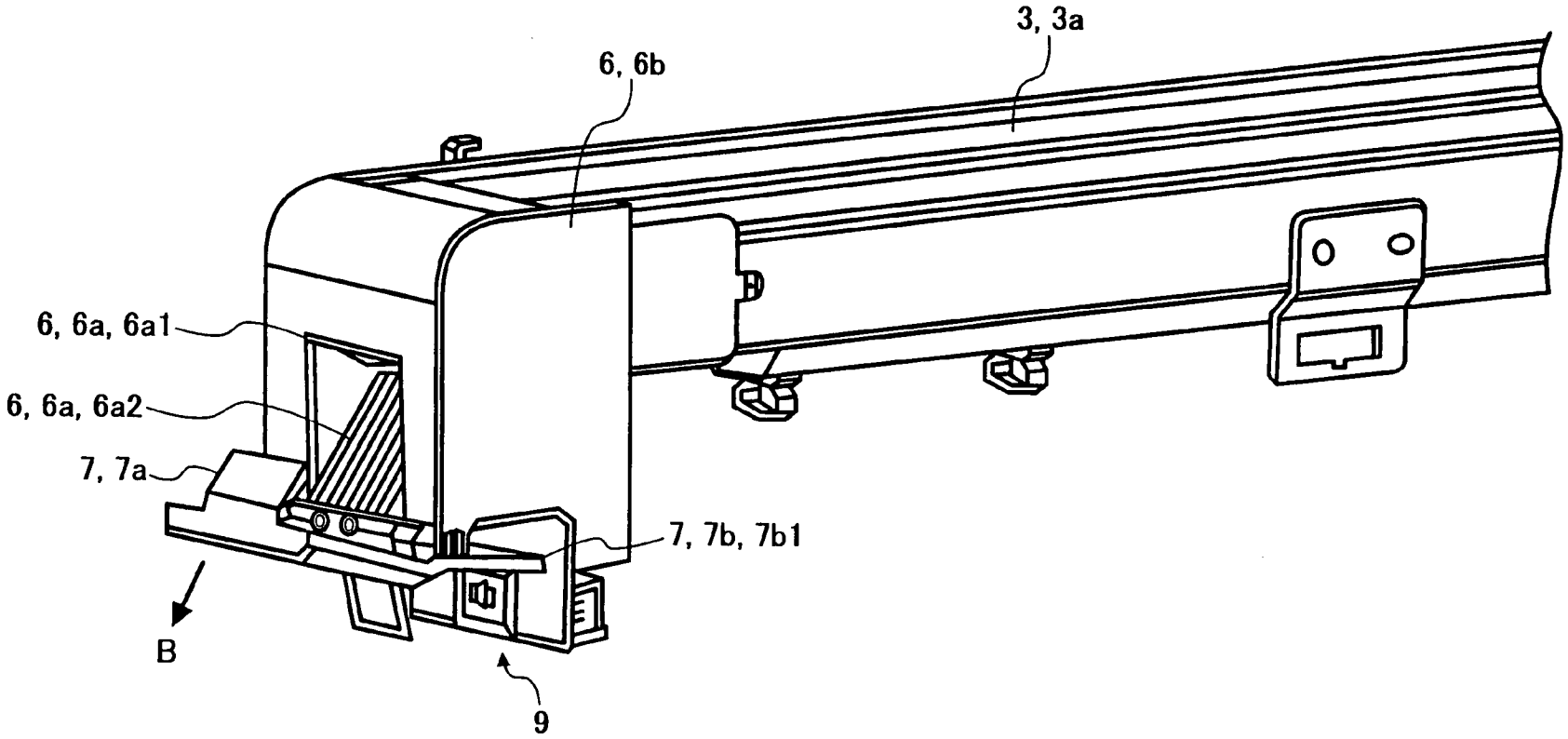
FIG. 5 is a schematic perspective view showing the state of the shielding member in FIG. 2.

The chad p resulting from perforating the paper P with the punch 2*a* and die 2*b* falls on the delivery member 3*a* that rotates in the direction of the arrow A, then delivered to the operating side of the opening and closing door 0*a*1, and caused to pass through the guiding delivery opening 6*a*1 and the declining part 6*a*2 of the chad guide 6 to be stored in the chad storage hopper 5*a* as shown in FIGS. 1 and 2, whereupon the shielding part 7*a* rotates in the direction of the arrow B in FIGS. 1 and 2 to reach an opened state (see FIG. 5). A detachment detection part 7*b* of the chad storage device extends integrally with the shielding part 7*a* on the opposite side of an axle for pivotably supporting the shielding part 7*a*. The presence of the detachment detection part 7*b* is detected by a detection device 9 composed of a reflective photosensor.

Figure 3:
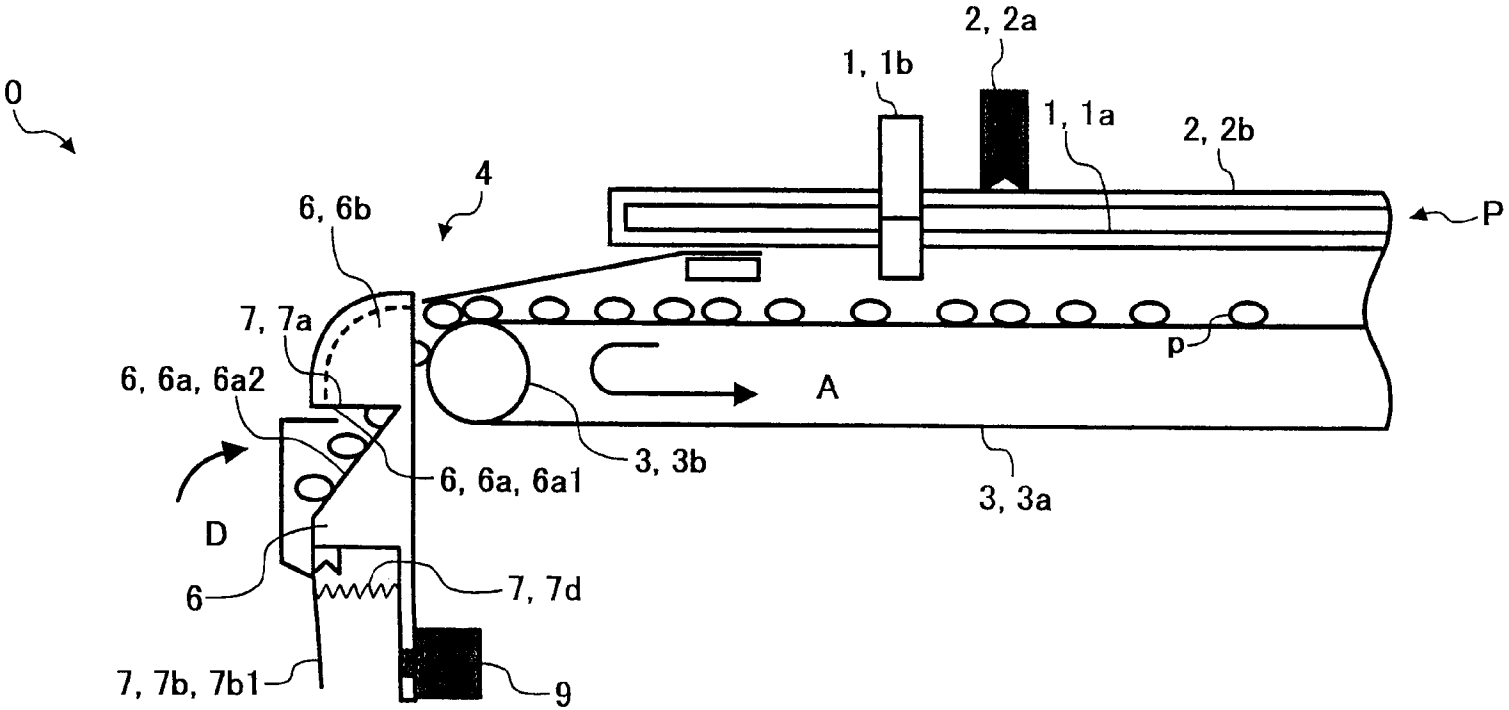
FIG. 3 is a diagram showing a state in which the shielding member blocks off the opening in FIG. 2.
Figure 4:
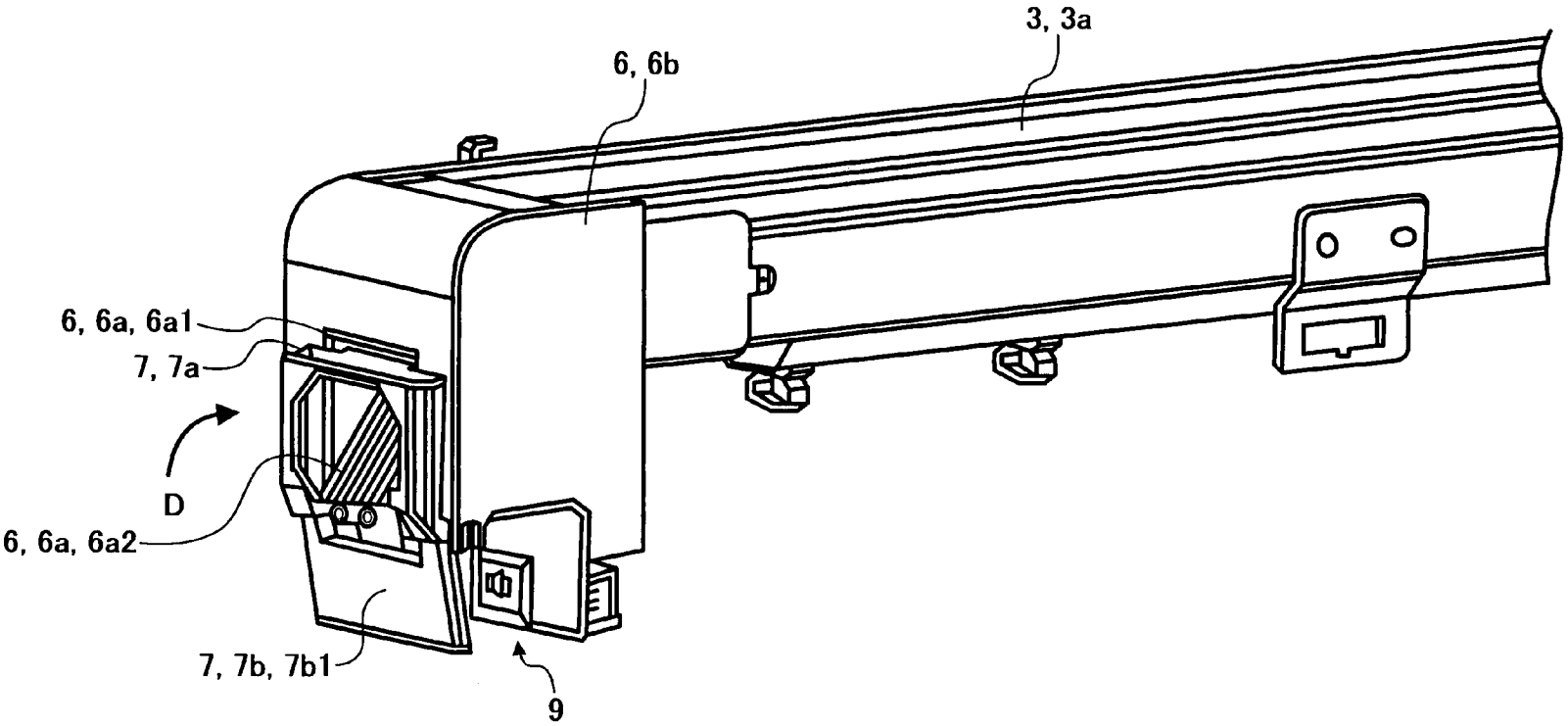
FIG. 4 is a schematic perspective view showing the state of the shielding member in FIG. 3.

When the shielding part 7*a* is closed as in FIG. 4, the detecting sensor of the detection device 9 detects the detachment detection part 7*b*, and when the shielding part is open as in FIG. 5, the detachment detection part 7*b* is no longer detected because the detachment detection part 7*b* is out of the path of the detected light, and the amount of chad p stored in the chad storage hopper 5*a* can be detected through a hole 5*b* provided to the chad storage hopper 5*a*. The chad storage hopper 5*a* can thereby also be automatically detected to be full with chad p by the detection device 9. Specifically, the chad storage hopper 5*a* mounted on the inner side of the opening and closing door 0*a*1 reaches a state such as is shown in FIG. 2 due to pressing on the front surface 7*b* 1 of the detachment detection part 7*b* in the direction of the arrow C in FIGS. 1 and 2 when the opening and closing door 0*a*1 is closed, and the chad storage hopper 5*a* can be automatically detected to be full with chad p as a result. Also, when the opening and closing door 0*a*1 is opened, the chad storage hopper 5*a* mounted on the inner side of the opening and closing door 0*a*1 is separated from the front surface 7*b* 1 of the detachment detection part 7*b*, and the detachment detection part 7*b* reaches a state such as is shown in FIG. 3 due to the torsion spring 7*d* (see FIG. 4).

The torsion spring 7*d* applies elastic urging force such that the detachment detection part 7*b* reaches a state such as is shown in FIG. 3 (state in which the part is located at the front of the detection device 9) (see FIG. 4). When the detachment detection part 7*b* reaches a state such as is shown in FIG. 3, the detection sensor of the detection device 9 can detect the detachment detection part 7*b* and recognize that the chad storage hopper 5*a* has been removed. At this time, the shielding part 7*a* provided to the opposite side around the rotational axis rotates in the direction of the arrow D in FIG. 3 and automatically blocks the opening 6*a*1 of the guiding delivery channel 6*a*, so it is possible to prevent the chad p remaining in the center of the hole 6*b* in the chad guide 6 from overflowing.

Thus, since the shielding part 7*a* is subjected to the action of elastic urging force in the direction in which the opening 6*a*1 is always shielded, the chad p can be reliably prevented from falling or scattering into the apparatus, and the chad p can also be reliably stored in the chad storage hopper 5*a* on the operating side of the opening and closing door 0*a*1. As a result, it is possible to provide a compact perforator 0 with a favorable appearance and superior operability, wherein erroneous detection and operation in the sensors is prevented.

A press punch-type (see FIGS. 11 and 12) or rotary punch-type (see FIGS. 13 and 14) perforator can be installed as the perforating device 2 in the perforator 0. When either type of perforator 0 is used, the chad p resulting from perforating the paper P fed from the feed opening 1*a* and feed rollers 1*b* with the punch 2*a* and die 2*b* falls onto the delivery member 3*a* (delivery belt) of the chad recovery/delivery device 3. As shown in FIG. 1, the delivery member 3*a* is stretched to undergo tension by the timing pulley of the pulley 3*b* and the timing pulley of the pulley 3*c*, and the delivery member 3*a* on the falling side of the chad p moves in the direction of the arrow A in FIGS. 1 and 2, whereby the chad p is delivered to the operating side of the opening and closing door 0*a*1 and is separated at the curved part 4 by the hole 6*b* in the chad guide 6.

The delivery member 3*a* is driven as a result of the fact that a worm wheel 3*c*1 integrated with the timing pulley of the pulley 3*c* is meshed with a worm 3*c*2 and that the worm 3*c*2 is rotated. The worm 3*c*2 is rotatably driven by a stepping motor 3*d* via a timing belt 3*e*.

The chad p delivered to the operating side of the opening and closing door 0*a*1 by the delivery member 3*a* and separated from the curved part 4 passes through the guiding delivery opening 6*a*1 of the delivery channel 6*a* and a sloping guide of the guiding delivery slide unit 6*a*2, and falls into the detachable chad storage hopper 5*a*, where it is stored. The chad storage hopper 5*a* is mounted in a detachable configuration on the inner side of the openable and closable opening and closing door 0*a*1, or on the inner side of a paper finisher 10 (not shown). Therefore, the chad p falls into the apparatus and is reliably stored in the chad storage hopper 5*a* on the operating side of the opening and closing door 0*a*1 without scattering.

A magnet 5*a*1 is mounted on the chad storage hopper 5*a*, and is held by magnetism to a bracket 0*a*2 affixed to the inner side of the opening and closing door 0*a*1. Pins 0*a*3 and 0*a*4 are provided to part of the opening and closing door 0*a*1 as guides during magnetization, a guide function is provided by inserting the pins through a hole provided to the side wall of the chad storage hopper 5*a*, and the chad storage hopper 5*a* is capable of being attached or detached due to the presence or absence of magnetism in the magnet 5*a*1 and the bracket 0*a*2.

Figure 6:
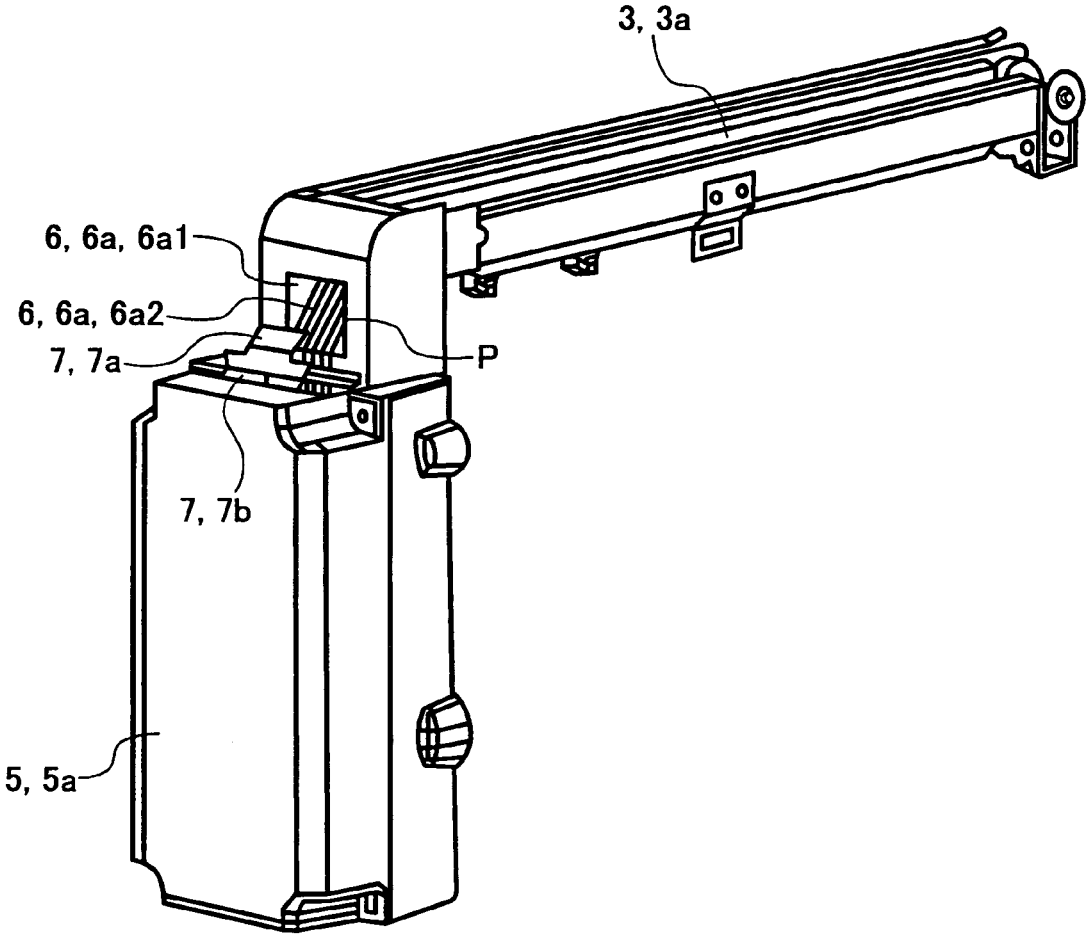
FIG. 6 is a schematic perspective view showing the mounted state of the chad storage hopper in FIG. 5.
Figure 7:
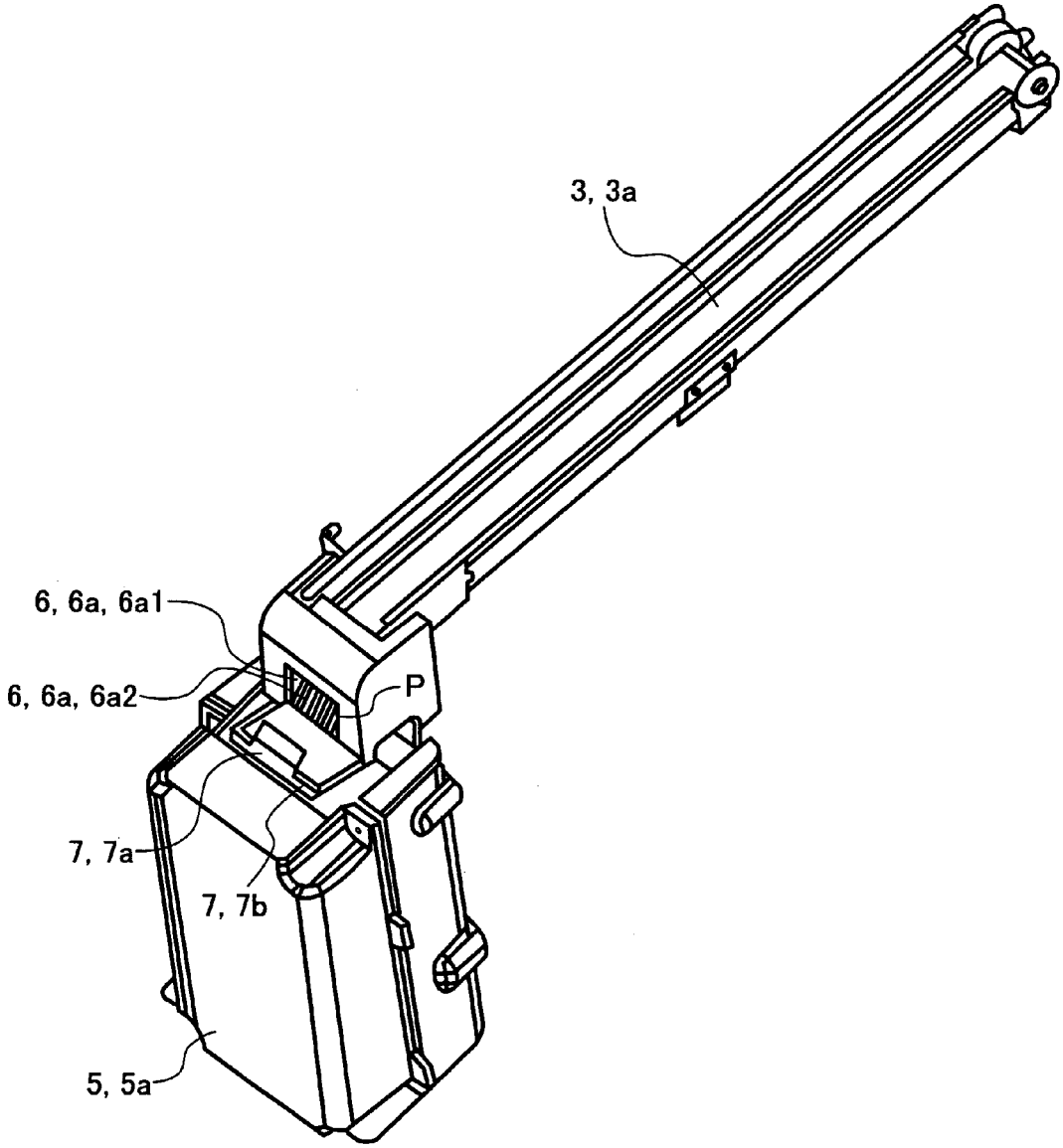
FIG. 7 is another schematic perspective view of the perforator in FIG. 6.
Figure 8:
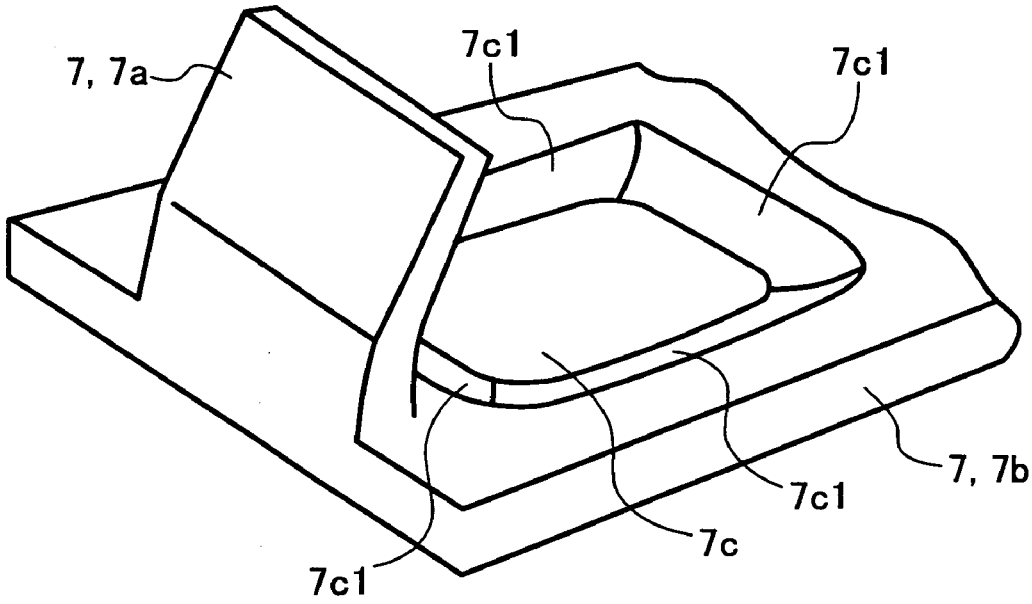
FIG. 8 is an enlarged perspective view of the shielding member in the same embodiment.

The configuration of a perforator relating to another embodiment of the present invention is shown in FIGS. 6 through 8. In these diagrams, a chad through-hole 7*c* is provided to prevent circumstances in which the chad p passing through the opening 6*a*1 of the guiding delivery channel 6*a* and the sloping guide of the guiding delivery slide unit 6*a*2 to be stored in the chad storage hopper 5*a* could be caught on the detachment detection part 7*b* and not fall, and the surrounding frame of the chad through-hole 7*c* is provided with a slanted surface part 7*c* 1 whose surface is slanted such that the opening narrows down in the direction in which the chad p is delivered (the falling direction) (see FIG. 8). Such a hole configuration allows the chad p to slide off the slide surface of the slanted surface part 7*c* 1 and be reliably stored in the chad storage hopper 5*a*, even if the chad p falls into the chad through-hole 7*c* or the frame surrounding the chad through-hole 7*c*.

Figure 9:
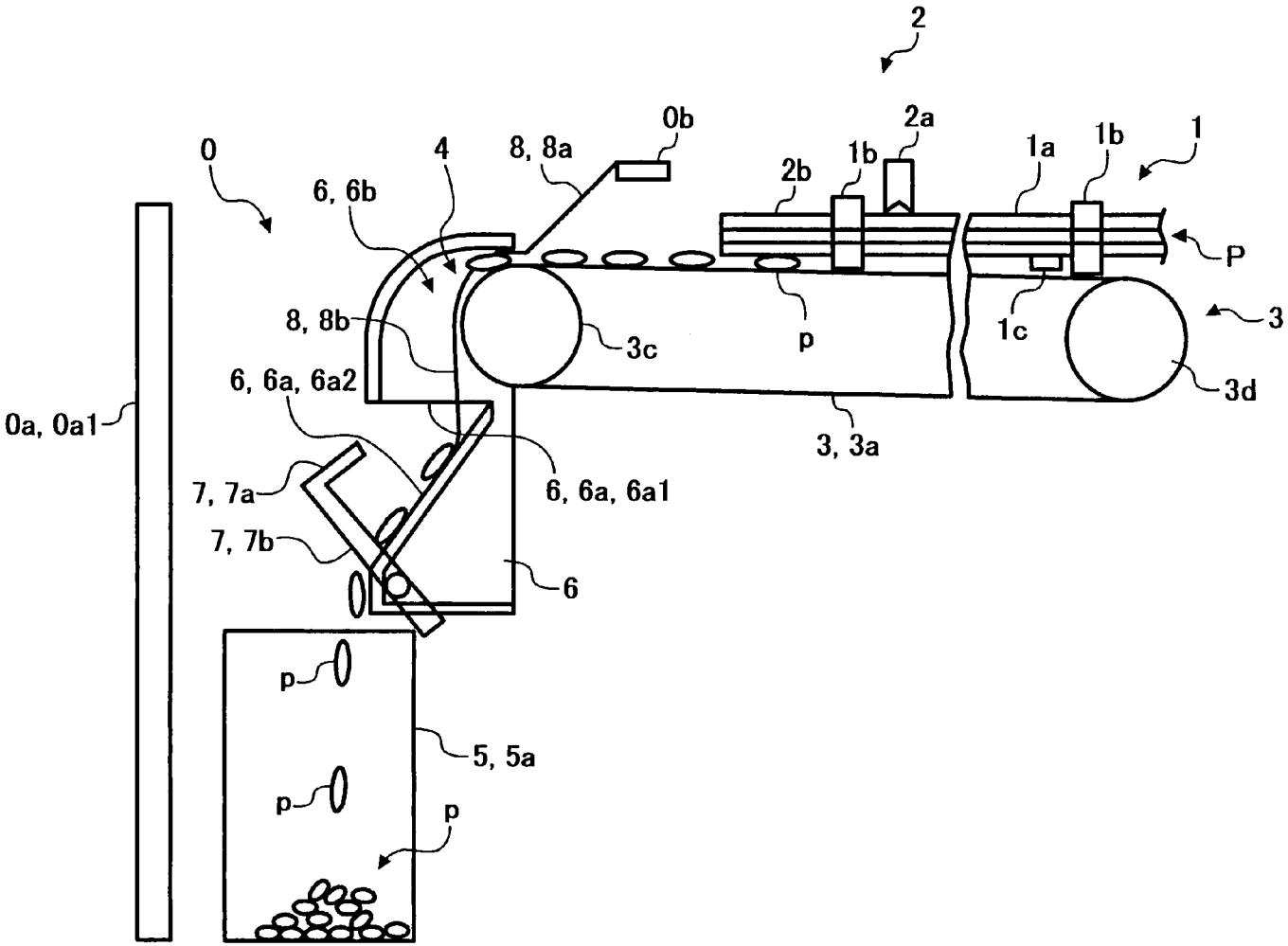
FIG. 9 is a diagram showing the schematic structure of a perforator relating to another embodiment of the present invention in which a chad separation accelerator is used.

The configuration of a perforator relating to another embodiment of the present invention, wherein a chad separation accelerator 8 is provided to the chad guide 6, is shown in FIG. 9. In this diagram, the chad separation accelerator 8 accelerates the separation of the chad p delivered by the delivery member 3*a*, and a pressing member 8*a* constituting the chad separation accelerator 8 presses on the back tips of the chad p on the delivery member 3*a* upstream of the curved part 4 to cause the front tips of the chad p to rise from the top of the delivery member 3*a*, whereby the chad p easily separates from the delivery member 3*a* at the curved part 4. Thus, the chad p on the delivery member 3*a* is caused to separate from the delivery member 3*a* and is reliably stored in the chad storage hopper 5*a* of the chad storage device 5. The pressing member 8*a* is made from a resin material in film form, is therefore easily machined and attached, and is fixed and held by a main body frame 0*b* or another such fixing member.

A peeling member 8*b* constituting the chad separation accelerator 8 is disposed on the curved part 4 immediately after the part where the pressing member 8*a* is set in the delivery path of the chad p. This peeling member 8*b* further accelerates peeling due to the pressing member 8*a*, and has the function of bringing the tip of the peeling member 8*b* in contact with the bottom of the tips of the chad p whose tips are raised by the pressing member 8*a*, and peeling the chad p from the top of the delivery member 3*a* to reliably separate the chad p from the delivery member 3*a*.

Thus, the chad p on the delivery member 3*a* can be reliably separated from the delivery member 3*a* as a result of the tip of the peeling member 8*b* coming into contact with and pushing up the raised portions of the chad p whose tips have been raised from the delivery member 3*a* by the pressing member 8*a*. The peeling member 8*b* is composed of a resin material in film form and is therefore easily machined and attached, and the member is fixed and held on the chad guide 6. The chad separation accelerator can thereby be configured at low cost.

Consequently, the chad p formed by perforating the fed paper P with the punch 2*a* and die 2*b* can be reliably separated from the delivery member 3*a* for delivery to the operating side of the opening and closing door 0*a*1, and can be reliably stored in the chad storage hopper 5*a*.

Figure 10:
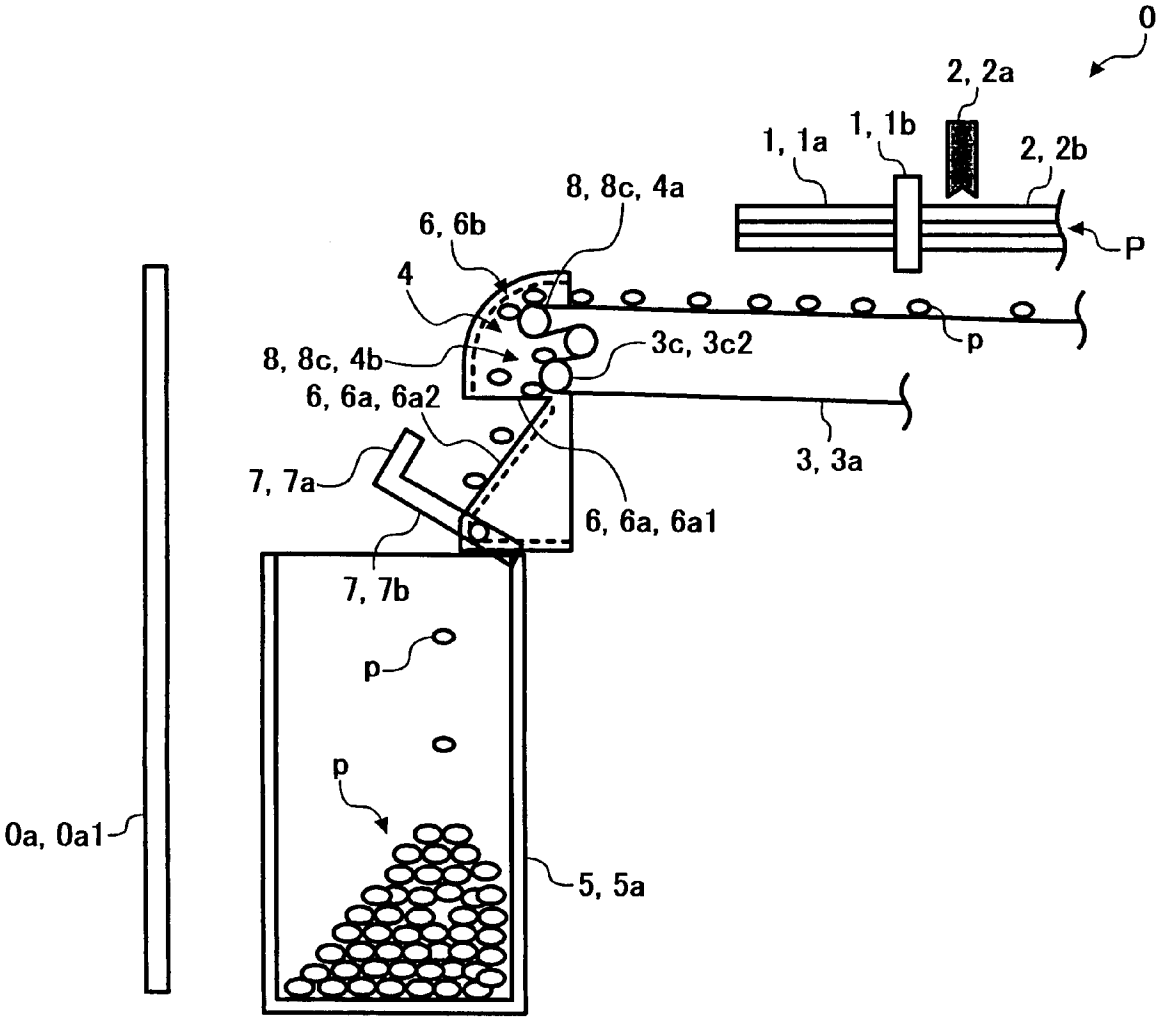
FIG. 10 is a diagram showing the schematic structure of a perforator relating to yet another embodiment of the present invention in which a curved part is provided in two stages.

The configuration of a perforator relating to yet another embodiment of the present invention that includes another chad separation accelerator 8 is shown in FIG. 10. Specifically, in this embodiment, the chad separation accelerator 8 for accelerating the separation of the chad p delivered by the delivery member 3*a* is configured from a plurality of curved parts 8*c* (curving delivery parts). These curved parts 8*c* are composed of high positioned curved parts 4*a* and low positioned curved parts 4*b* disposed at a lower position than the high positioned curved parts 4*a*. A plurality of these curved parts 4*a* and 4*b* is set at positions of different height, whereby the chad p formed by perforating the fed paper P with the punch 2*a* and die 2*b* can be reliably separated from the delivery member 3*a* for delivery to the operating side of the opening and closing door 0*a*1 of the main body front surface 0*a*. In this embodiment, among the plurality of curved parts 8*c*, the high positioned curved parts 4*a* protrude farther out to the side of the opening and closing door 0*a*1 than the low positioned curved parts 4*b*. This allows the chad p separated from the delivery member 3*a* at the first high positioned curved part 4*a* to come into contact with, but not adhere to, the next low positioned curved part 4*b*, whereby the chad p falls into the guiding delivery slide unit 6*a*2 of the guiding delivery channel 6*a* in the chad guide 6, and can be reliably stored in the chad storage hopper 5*a*. Also, the purpose of disposing the high positioned curved parts 4*a* and the low positioned curved parts 4*b* at different heights is to ensure that the chad guide 6 does not increase in size.

Figure 11:
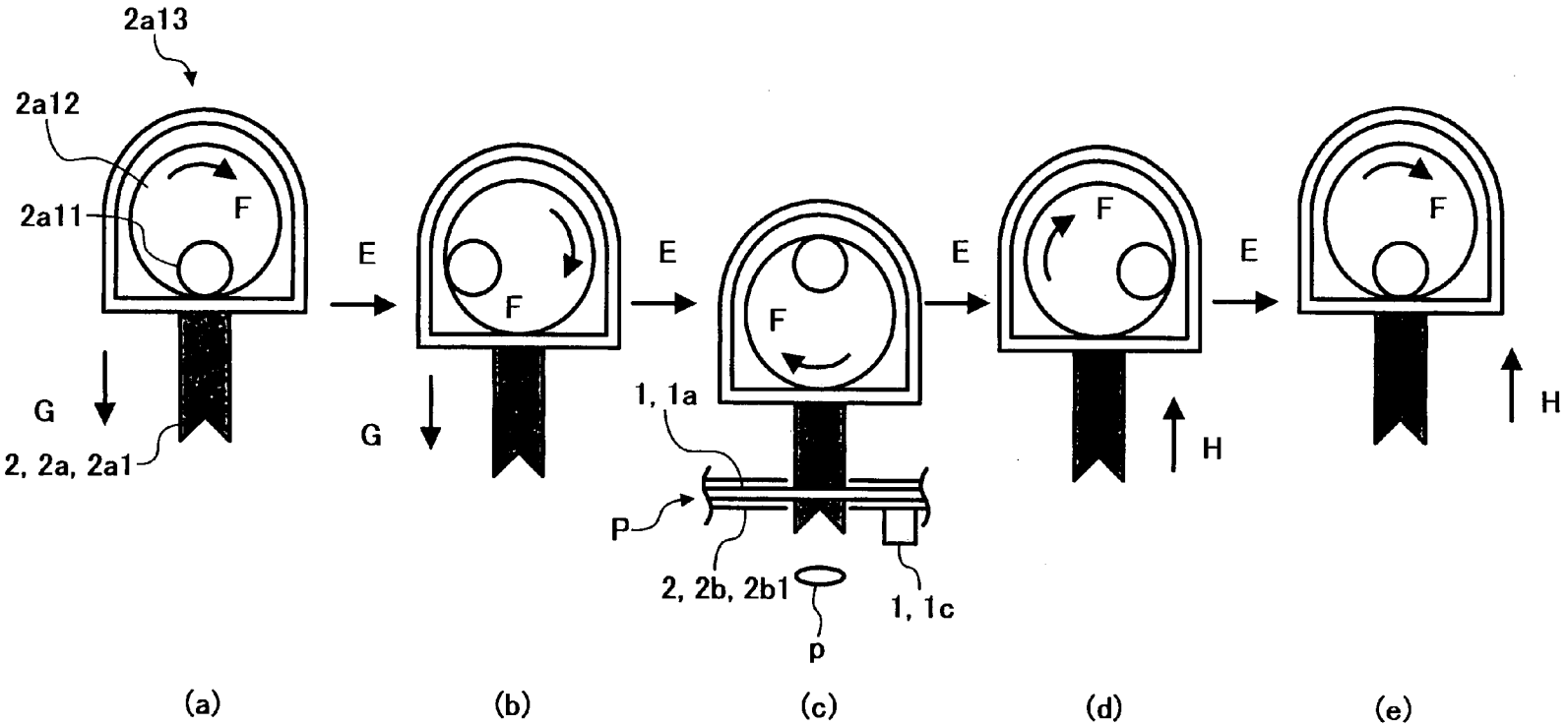
FIG. 11 is an explanatory diagram of the perforating operation of a press punch perforator in the present invention.

Next, a press punch-type perforating operation will be described with reference to FIG. 11. The symbols (a) through (e) in FIG. 11 indicate an operating simulation for the perforating blade 2*a*1 of the punch 2*a* in the perforating device 2 in the direction of the arrows E in the diagram. The perforating blade 2*a*1 is moved up and down in relation to the paper P in the direction of the arrow G in the diagram or in a direction perpendicular to the direction of the arrow H in the diagram by a cam 2*a*12 that rotates around an axle 2*a*11 in the direction of the arrow F in the diagram, and the paper P is perforated in the state indicated by (c) in FIG. 11. The perforated location is set after a specific time passes since the back edge of the paper P has passed through an inlet sensor 1*c* disposed in the feed opening 1*a*, or after a set pulse has passed, and the paper is perforated by the press-punch perforating blade 2*a*1 when the paper has stopped after the specific time or the set pulse has passed.

Figure 12:
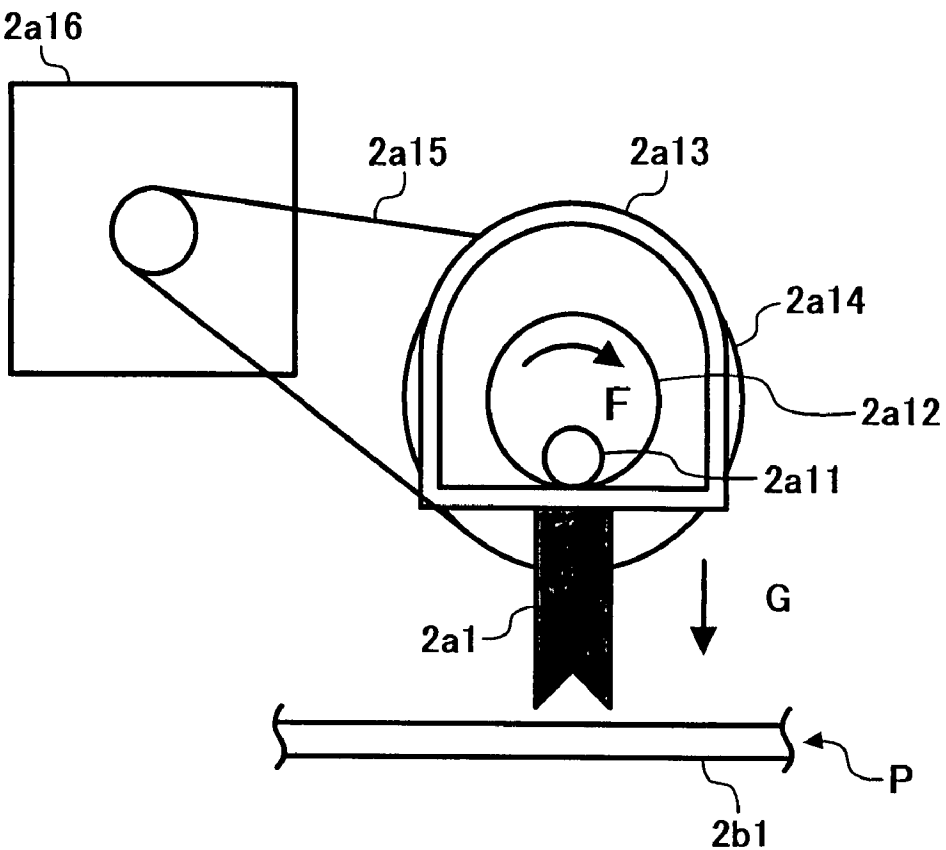
FIG. 12 is a diagram showing the configuration of a perforating mechanism containing the drive mechanism of the press punch perforator in FIG. 11.

The configuration of a press-punch perforating device 2 having a drive mechanism is shown in FIG. 12. In this diagram, the press-punch perforating blade 2*a*1 presses the inner wall of a holder 2*a*13 in contact with the outer cam surface of the cam 2*a*12 down towards the paper P in the direction of the arrow G in the diagram when the cam 2*a*12 meshed with the axle 2*a*11 rotates around the axle 2*a*11 in the direction of the arrow f in the diagram. The pressed down holder 2*a*13 performs perforation by pressing the press-punch perforating blade 2*a*1 meshed with the holder 2*a*13 down towards the paper P in the direction of the arrow G in the diagram.

A pulley 2*a*14 is mounted on the axle 2*a*11, and this pulley is rotated by a drive from a stepping motor 2*a*16 via a timing belt 2*a*5. The drive from the pulley 2*a*14 to the axle 2*a*11 causes the pulley 2*a*14 to be constantly rotated by the stepping motor 2*a*16 via the timing belt 2*a*15, and this drive is transmitted to the axle 2*a*11 by a single rotation clutch when needed. Alternatively, a configuration is possible wherein the stepping motor 2*a*16 instead of a single rotation clutch is repeatedly stopped and driven to transmit the drive to the axle 2*a*11.

Next, a rotary-punch perforating operation will be described with reference to FIG. 13. The symbols (a) through (e) in FIG. 13 indicate an operating simulation for the perforating blade 2*a*2 of the punch 2*a* in the perforating device 2 in the direction of the arrows I in the diagram. The rotary-punch perforating blade 2*a*2 rotates around an axle 2*a*21 in the direction of the arrow J in the diagram, and a rotary punch-type die 2*b*2 for the die 2*b* is provided at a position lined up with the perforating blade 2*a*2. The die 2*b*2 rotates around an axle 2*b*21 in the direction of the arrow K in the diagram. The perforating blade 2*a*2 and the die 2*b*2 begin to rotate after the back edge of the paper P passes through the inlet sensor 1*c* disposed in the feed opening 1*a* and after a specific pulse has passed, and the paper P is perforated in the state shown in (c) of FIG. 13.

Figure 14:
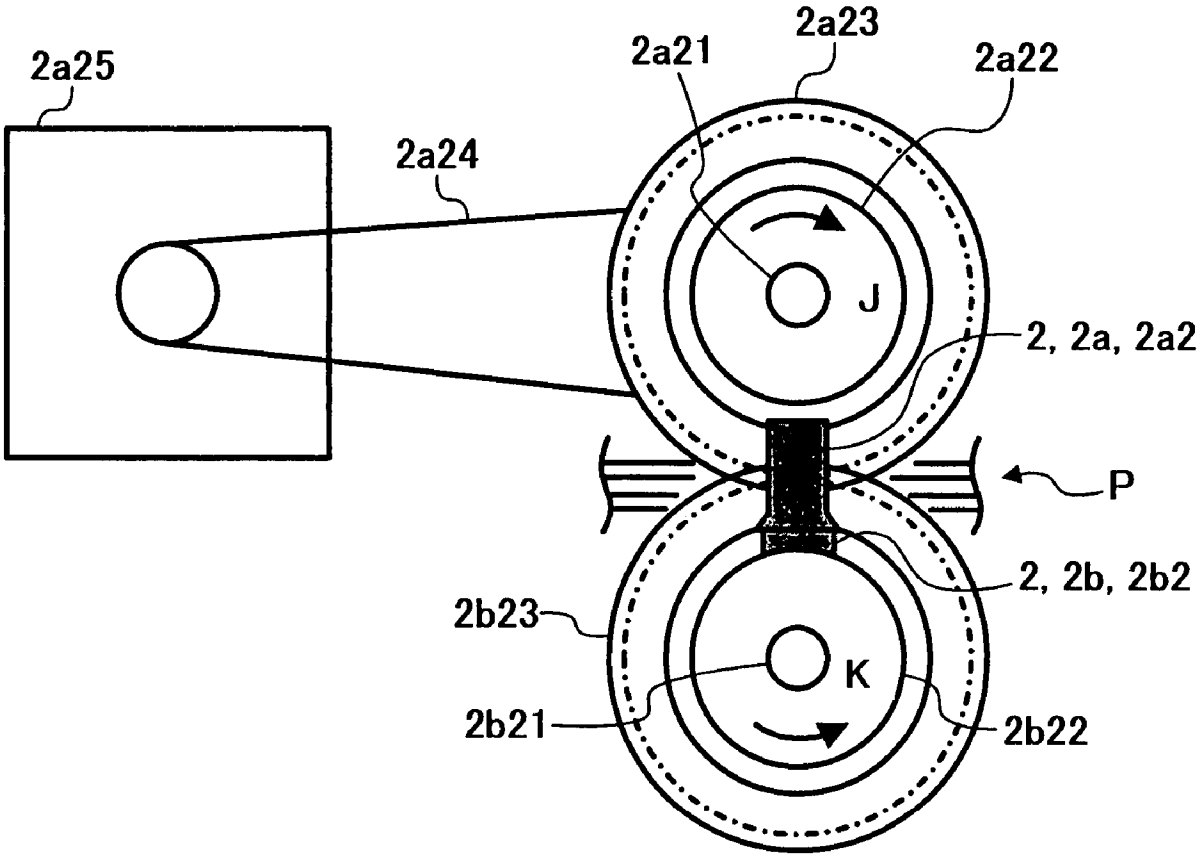
FIG. 14 is a diagram showing the configuration of a perforating mechanism containing the drive mechanism of the rotary punch perforator in FIG. 12.

The configuration of a drive system for a rotary punch perforator is shown in FIG. 14. The perforating blade 2*a*2 and the die 2*b*2 are mounted respectively on a pair of rotating members 2*a*22 and 2*b*22 sandwiching the paper P therebetween, as shown in the diagram. The rotating members 2*a*22 and 2*b*22 rotate around an axle 2*a*21 and an axle 2*b*21 in the direction of the arrows J and K in the diagram, respectively. A gear 2*a*23 and a gear 2*b*23 are mounted respectively on the axle 2*a*21 and the axle 2*b*21 of the perforating blade 2*a*2 and die 2*b*2, and rotational force is transmitted by the meshing of the gear 2*a*23 and the gear 2*b*23. The drive is transmitted to the gear 2*a*23 from a stepping motor 2*a*25 via a timing belt 2*a*24.

Figure 15:
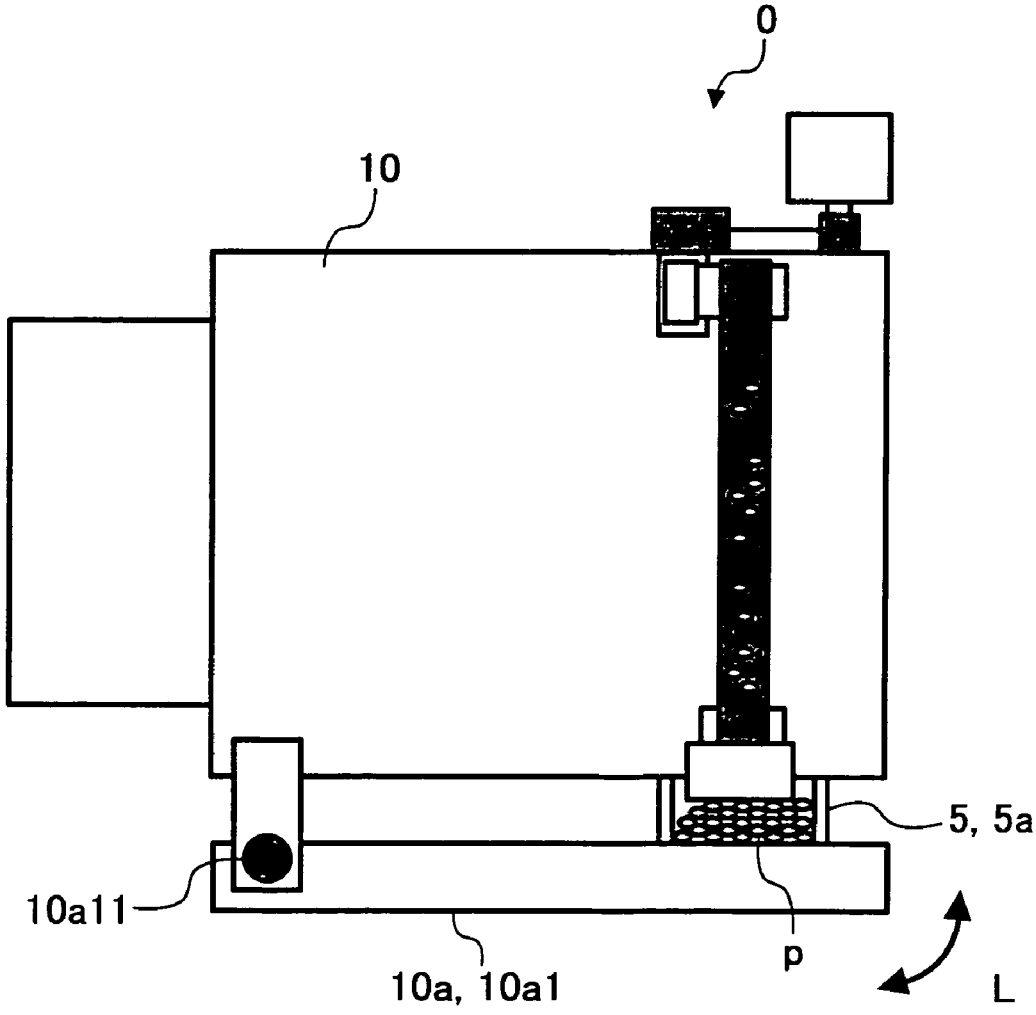
FIG. 15 is a plan view showing the primary configuration of a paper finisher relating to one embodiment of the present invention, that includes the perforator of the present invention.
Figure 16:
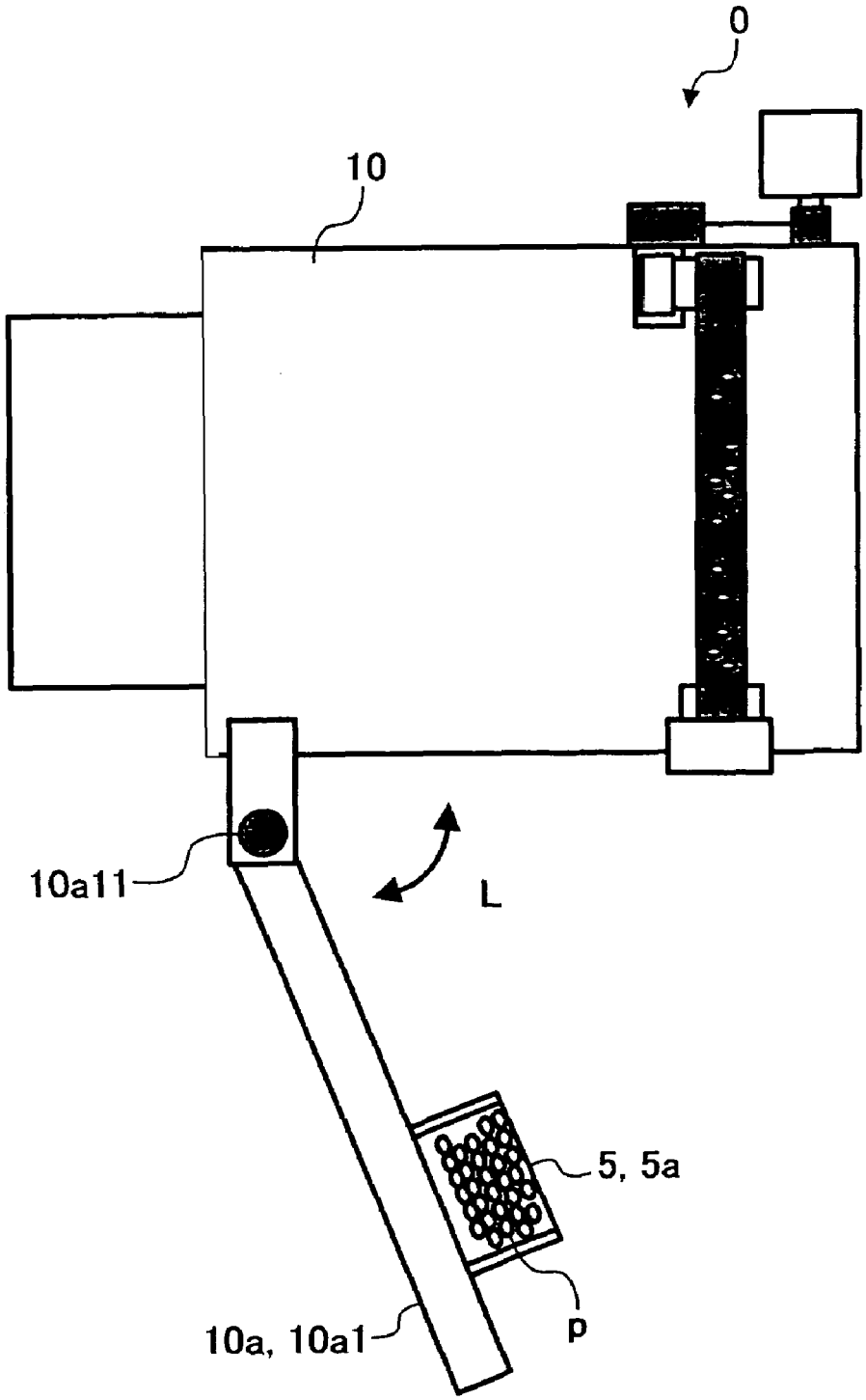
FIG. 16 is a plan view showing a state in which the cover is opened in FIG. 15.

The configuration of an embodiment relating to the paper finisher 10 that includes the perforator 0 of the present invention is shown in FIGS. 15 and 16. As can be seen from these diagrams, the front cover 10*a*1 capable of opening and closing in the direction of the arrow L in the diagram is provided in place of the opening and closing door 0*a*1 to the operating side of the main body front surface 10*a* of the paper finisher 10. The chad storage hopper 5*a* is mounted on the front cover 10*a*1. FIG. 15 shows the front cover 10*a*1 closed, and FIG. 16 shows the front cover 10*a*1 opened.

In this embodiment, when the front cover 10*a*1 turns around a fulcrum 10*a*11 to open (see FIG. 16), the chad storage hopper 5*a* also turns accordingly. In the chad storage hopper 5*a*, the delivery channel of a delivery device 11 (not shown) is blocked off when the front cover 10*a*1 is turned and closed (see FIG. 15), and even if an attempt is made to open or close the delivery channel of the delivery device 11 to remove a paper jam or the like, the chad storage hopper 5*a* remains fixed in its position and is not released, which makes it difficult to remove the paper jam. Specifically, when the front cover 10*a*1 is opened during to remove a paper jam or the like, the chad storage hopper 5*a* of the chad storage device 5 must also move integrally with the front cover 10*a*1. In view of this, the paper finisher 10 relating to this embodiment is configured such that the chad storage hopper 5*a* also turns integrally when the front cover 10*a*1 is opened. The front cover 10*a*1 is thereby integrally opened to remove a paper jam, so operability is not affected. Also, there is no need for a configuration in which the chad storage hopper 5*a* can be mounted between the mechanisms in the paper finisher 10, and the hopper is provided to the inner side of the front cover 10*a*1. Therefore, the chad storage hopper 5*a* can be enlarged and the capacity for storing chad p can be increased within a small space.

Figure 17:
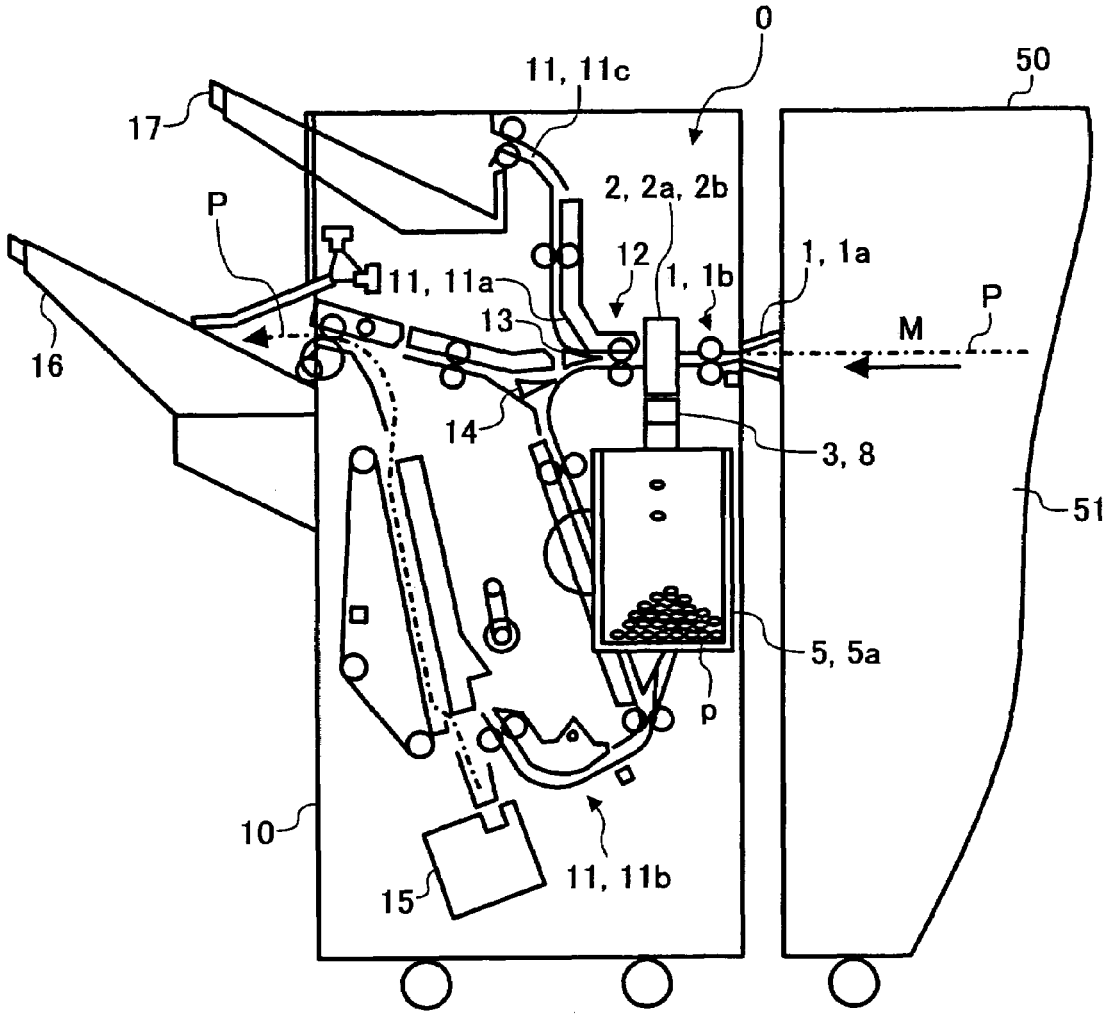
FIG. 17 is a schematic structural view of a paper finisher relating to another embodiment of the present invention.
Figure 18:
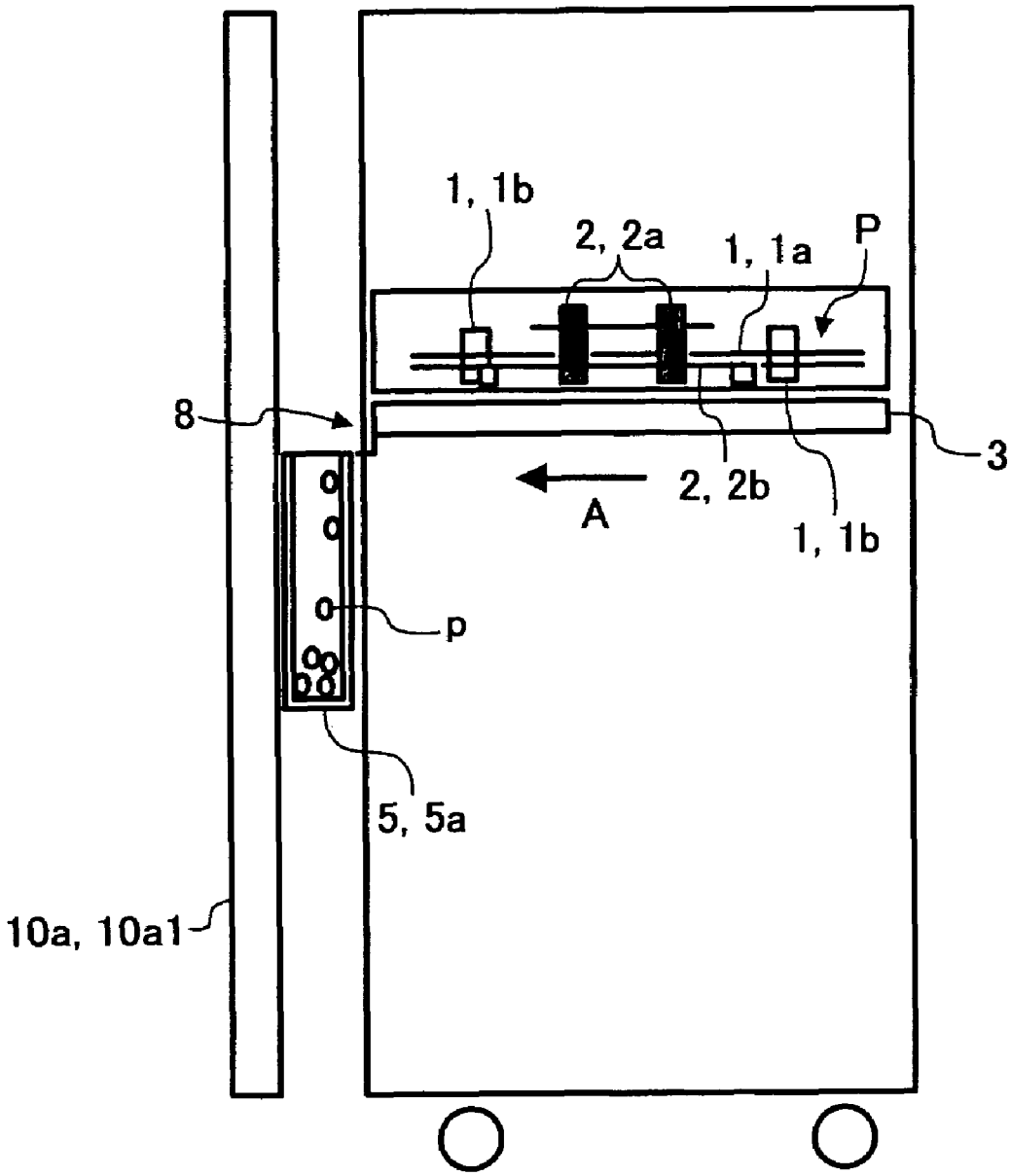
FIG. 18 is a side view showing the schematic structure of the paper finisher in FIG. 17.
Figure 19:
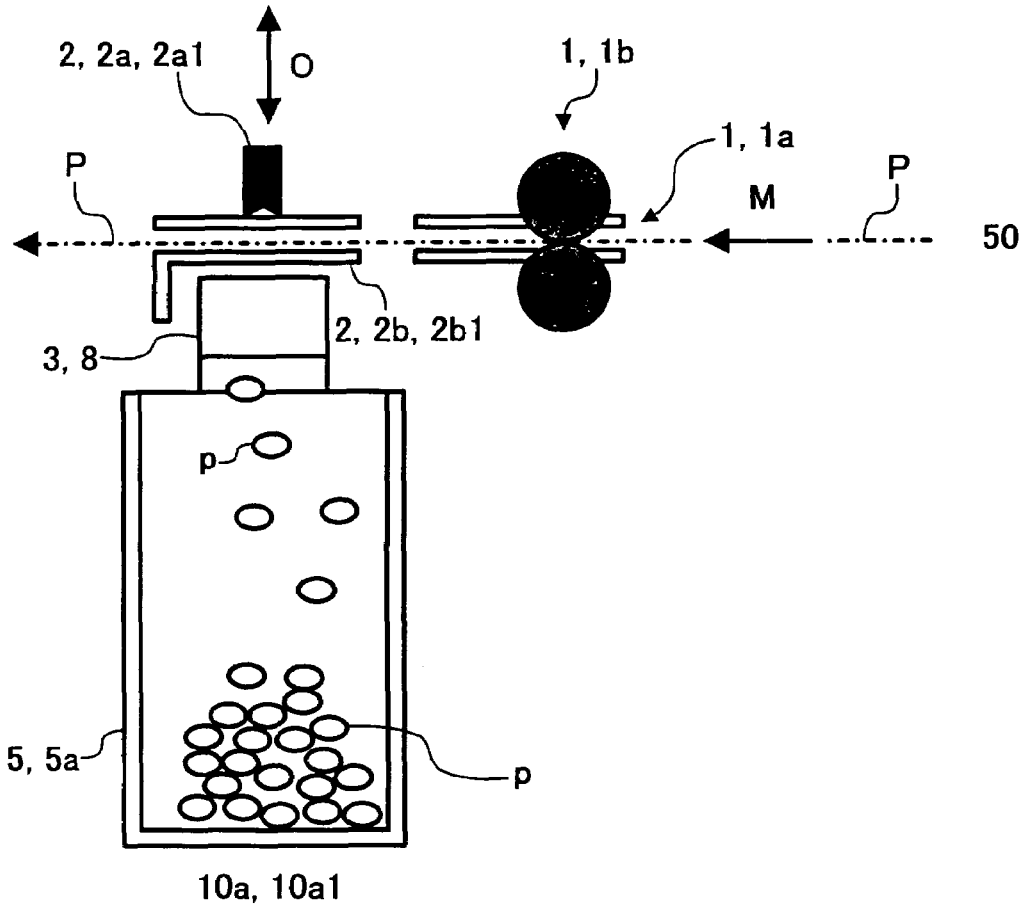
FIG. 19 is a diagram showing an enlarged view of the main section of the perforator in the paper finisher in FIG. 17.

The internal configuration of a paper finisher 10 relating to another embodiment that includes the perforator 0 of the present invention is shown in FIGS. 17 through 19. In these diagrams, an image is formed in the paper finisher 10 by the imaging device 51 of an imaging apparatus 50, and the discharged paper P is fed from the direction of the arrow M in the diagram (see FIG. 17). The paper P fed to the paper finisher 10 is delivered from the feed opening 1*a* of the perforator 0 by the feed rollers 1*b*, and is then delivered to a pair of delivery rollers 12 in the feed/delivery channel 11*a* of the delivery device 11 after passing through the feed rollers 1*b*. The punch 2*a* and die 2*b* of the perforator 0 for perforating the fed paper P are disposed between the feed rollers 1*b* and the delivery rollers 12. Also, a chad recovery/delivery device 3 for recovering the chad p after perforation has been performed by the punch 2*a* and die 2*b* is mounted together with the chad separation accelerator 8 (refer to the embodiments) as illustrated beneath the punch 2*a* and die 2*b* of the perforator 0.

After being perforated by the punch 2*a* and die 2*b*, the chad p is delivered in the chad delivery direction (the direction of the arrow A in FIG. 18) by the chad recovery/delivery device 3. This chad delivery direction is on the operating side of the front cover 10*a*1 by which the user operates the apparatus or deals with paper jams, and the chad p is stored by being loaded inside the chad storage hopper 5*a* disposed on the operating side of the front cover 10*a*1. The paper P perforated by the punch 2*a* and die 2*b* is delivered to the delivery channels due to the switching operation of a forked nail 13 and a forked nail 14 disposed downstream of the delivery rollers 12, and is loaded onto an discharged paper tray 16 after passing through a finishing delivery channel 11*b* of a delivery device 11 for performing a subsequent finishing step such as stapling in a stapler 15 or the like. Otherwise, if simple discharge is involved, the paper P is loaded on a proof tray 17 after passing through a simple discharge/delivery channel 11*c*. Specifically, since the punch 2*a*, the die 2*b*, and the chad storage hopper 5*a* are disposed the farthest upstream of the finishing steps, the paper P delivered essentially to any delivery channel 11*a*, 11*b*, or 11*c* can be perforated as a result.

Figure 13:
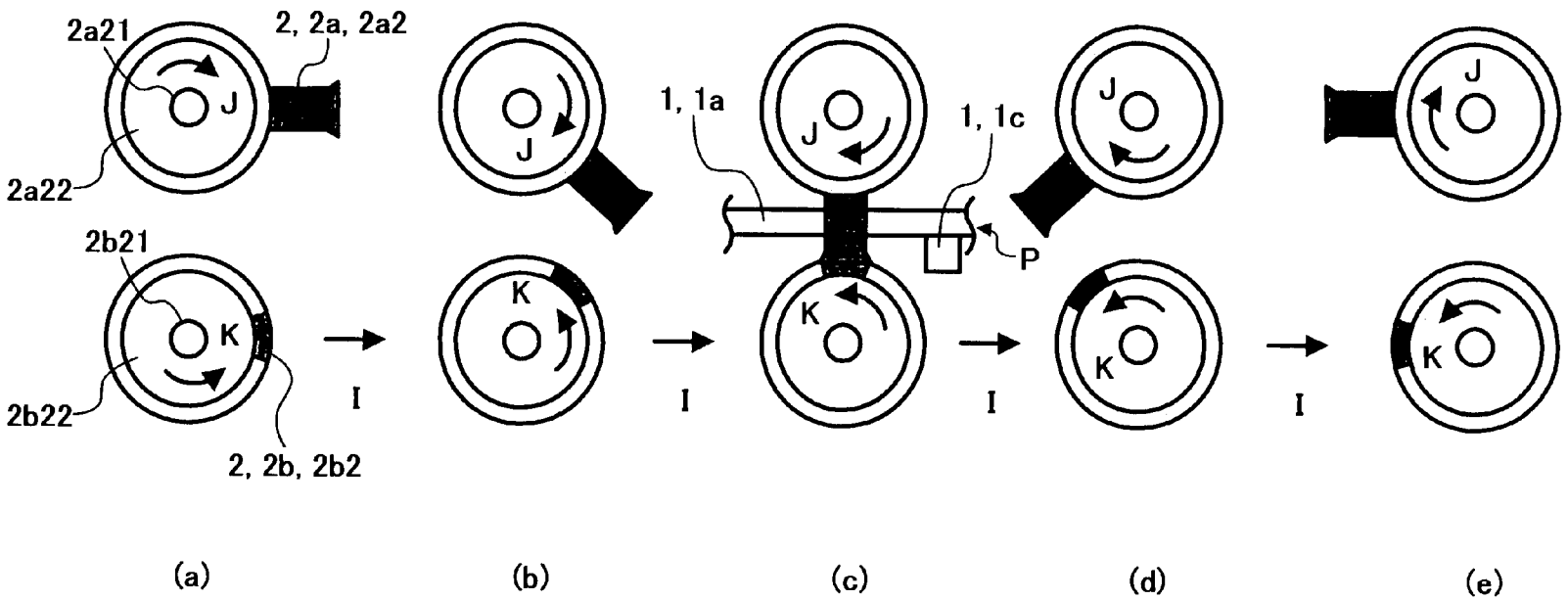
FIG. 13 is an explanatory diagram of a rotary-punch perforating operation in the present invention.

The perforating device 2 may either be of the press punch-type (see FIGS. 11 and 12), as shown in FIG. 19, or of the rotary punch-type (see FIGS. 13 and 14).

Figure 20:
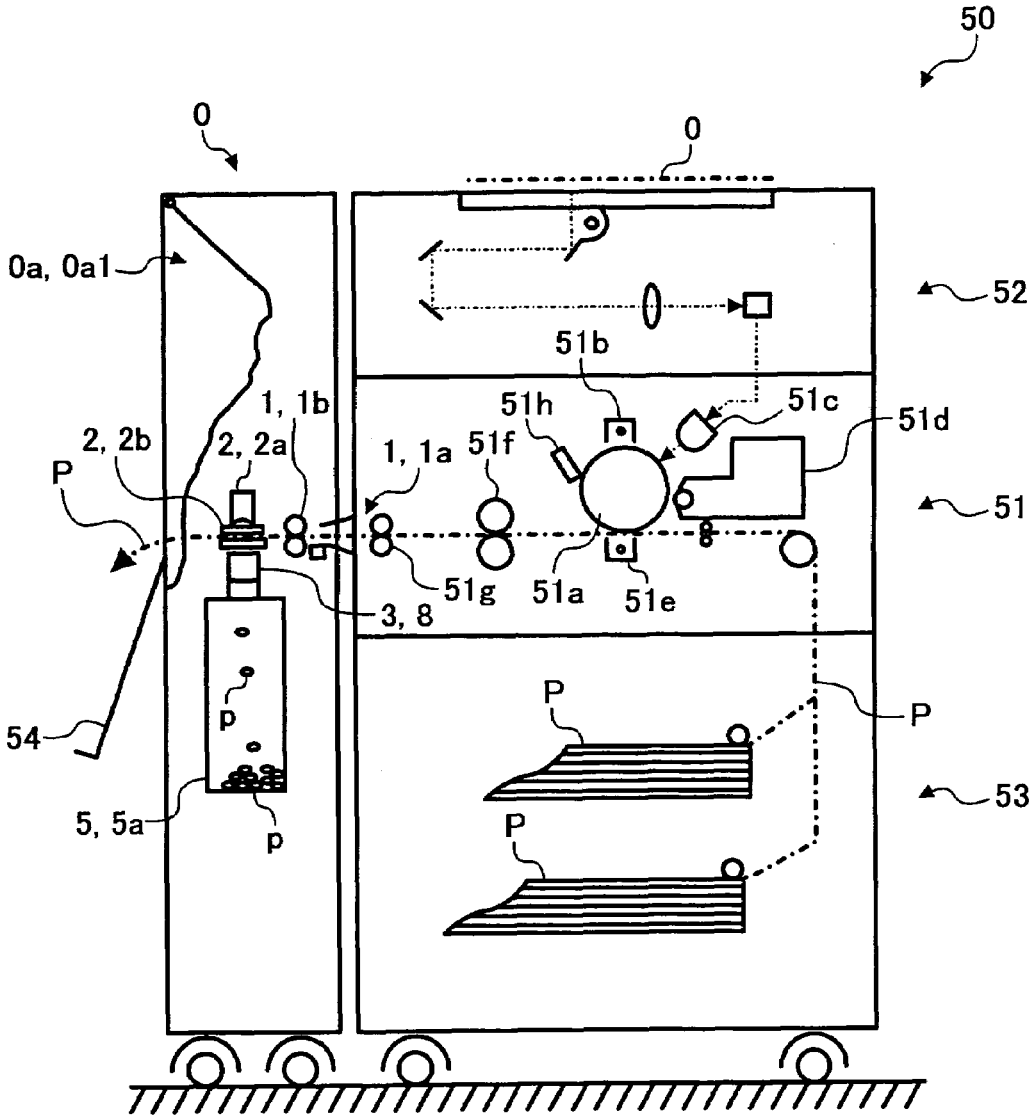
FIG. 20 is a diagram showing the schematic structure relating to an embodiment of an imaging apparatus equipped with the perforator of the present invention.

The configuration of an embodiment of an imaging apparatus equipped with the perforator of the present invention is shown in FIG. 20. In this diagram, the imaging apparatus 50 is composed of an imaging device 51 for forming an image on the paper P and a perforator 0 for perforating the paper P on which the image has been formed by the imaging device 51, the paper P fed to the perforator 0 is perforated by the press or rotary punch 2*a* and the die 2*b*, and the chad p resulting from this perforating operation is delivered to the operating side of the front cover 10*a*1 by the same configuration as in the embodiments previously described and is stored in the chad storage hopper 5*a*. Thus, it is possible to provide a compact imaging apparatus with a favorable appearance and superior operability, wherein erroneous detection and operation is prevented.

All types of apparatuses that use conventional imaging systems such as electronic photographing systems or ink-jet systems can be used for the imaging apparatus 50. Of these, a copy machine for forming a toner image in the same manner as with an electrophotographic system is configured such that a manuscript image reading device 52 for reading the image of a manuscript 0 is mounted in the top, and an imaging device 51 and a paper supply device 53 for supplying paper P to the imaging device 51 are mounted in the bottom. In the manuscript image reading device 52 of an imaging apparatus 50 based on this principle, a laser diode for an image writing device 51*c* is caused to generate light based on the image data of the manuscript 0 that has been read, the top of a photoreceptor drum of an image support 51*a* uniformly charged by an electrical charging device 51*b* is optically scanned, and an electrostatic latent image is formed on the surface of the photoreceptor drum. The image is then made visible by the toner development of the electrostatic latent image with a developing device 51*d*, and a toner image is formed.

The toner image made visible by the developing device 51*d* is transferred by a transferring device 51*e* to the paper P delivered from the paper supply device 53. The toner image transferred to the paper P by the transferring device 51*e* is fixed onto the paper P by the heat and pressure produced by a fixing device 51*f*, and the paper P on which the toner image is fixed is ejected to the feed opening 1*a* of the perforator 0 by a paper ejecting roller 51*g*.

Meanwhile, the photoreceptor drum of the image support 51*a* is cleaned by scraping off the adhered remaining toner with a cleaning member 51*h* after the toner image has been transferred to the paper P, and is used to form images in the next step. The paper P fed from the feed opening 1*a* of the perforator 0 is discharged and stored in an discharged paper tray 54 after being perforated by the operation of the punch 2*a* and die 2*b*.

Figure 21:
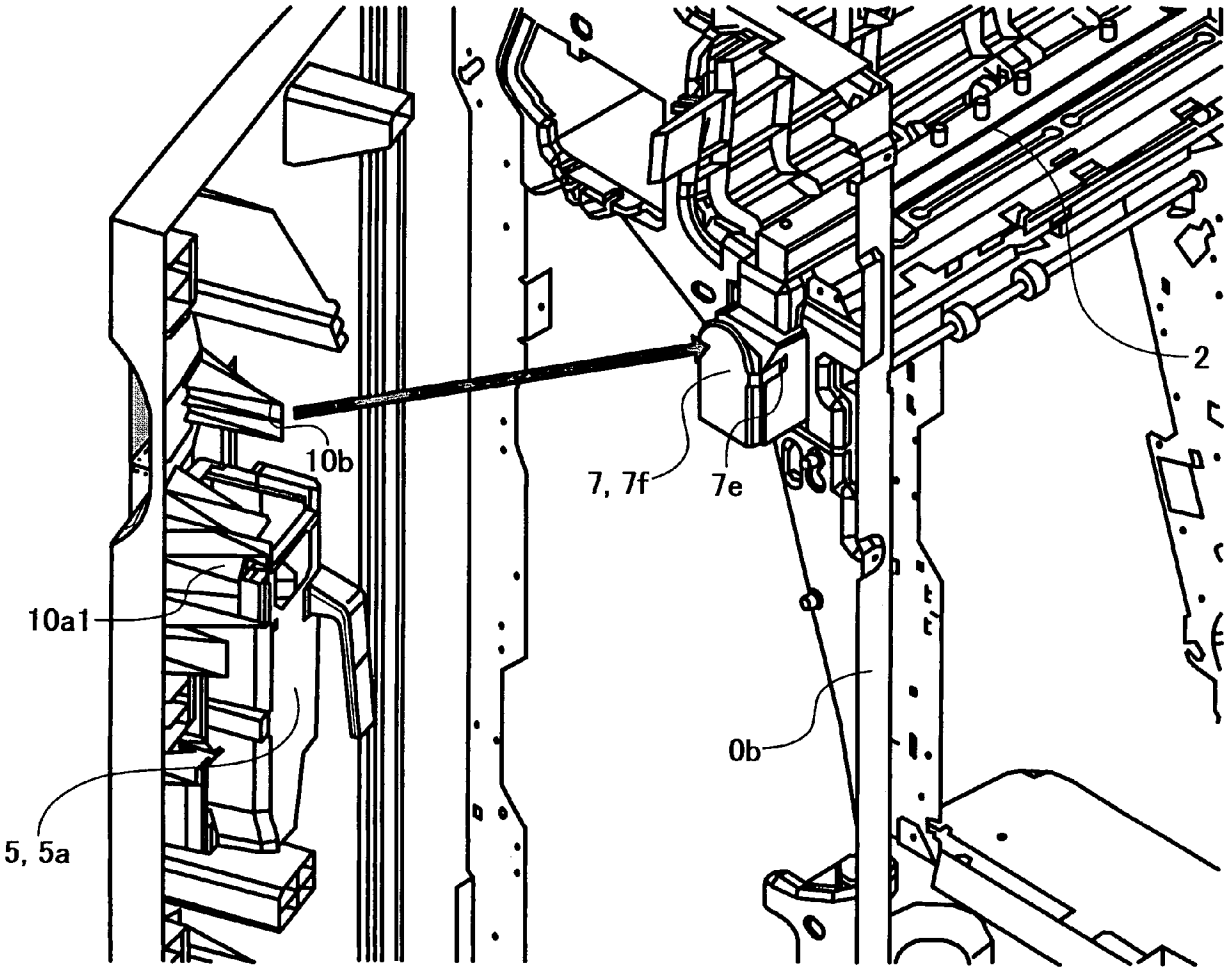
FIG. 21 is a perspective view showing the main section of a paper finisher relating to yet another embodiment of the present invention.
Figure 22A:
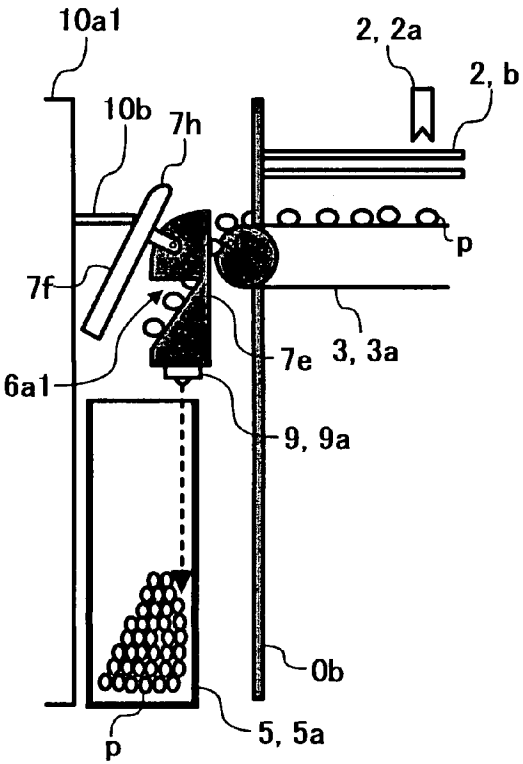
FIGS. 22A to 22C are operating explanatory diagrams showing the relationship between the opened/closed state of the cover, the chad storage hopper, and the shutter member in the paper handler in FIG. 21.
Figure 22B:
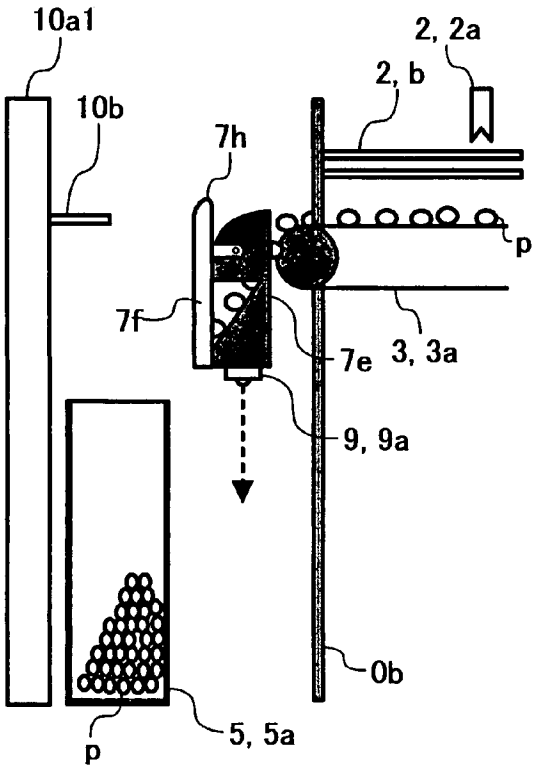
Figure 22C:
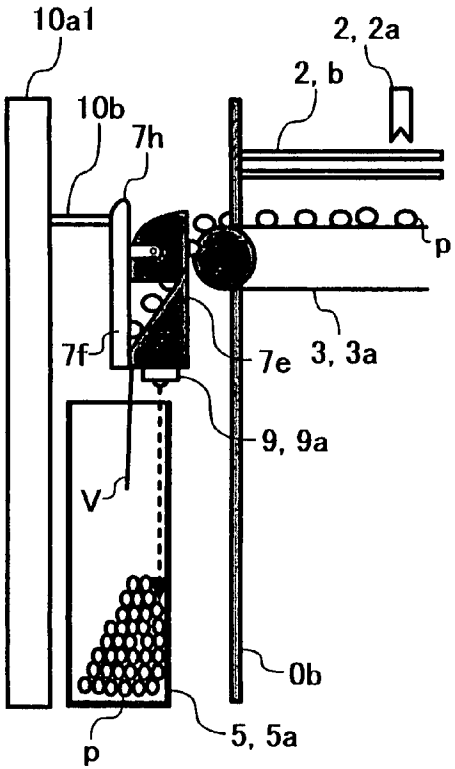

Following is a description of a paper finisher relating to another embodiment of the present invention shown in FIG. 21, and the operation of the perforator shown in FIGS. 22A through 22C.

This embodiment relates to the shielding member 7 shown in FIGS. 1 through 9, and another configuration whereby the shielding member 7 is operated. In this embodiment, the shielding member 7 is integrally formed from a shutter member 7*f*, an arm portion 7*g* that includes the fulcrum 7*e* at the tip, and an elastic urging device (spring) (not shown) for elastically urging the shutter member 7*f* in the normally closed direction. The arm portion 7*g* extends to the side of the main body of the chad guide 6 and can swing around the fulcrum 7*e*. When the shielding member 7 is not under a load (FIG. 22A), the shutter member 7*f* closes the opening 6*a*1 of the chad guide 6 by the elastic urging force of the elastic urging device, and the chad p is prevented from falling to the side of the chad storage hopper 5*a*. Also, the operating part 10*b* protruding into the front cover 10*a*1 comes into contact with a contact part 7*h* of the operating shutter member 7*f* at the top of the diagram, rotates the shutter 7*f* in the clockwise direction in the diagram against the elastic urging force of the elastic device, and allows the chad p to fall when the opening 6*a*1 is opened.

In this embodiment, the chad storage hopper 5*a* is detachably provided to the inner side of the front cover 10*a*1, and the amount of chad p stored in the chad storage hopper 5*a* is detected by a range sensor 9*a* provided as a detection device 9 to the bottom edge of the chad guide 6. This range sensor 9*a* detects the distance to the subject on the basis of the amount of light detected by a light-reflecting sensor and the light-receiving portion of the light-reflecting sensor, and functions as a fullness sensor for detecting whether the Chad storage hopper 5*a* has become full with Chad p. In this case, the distance is the height of the Chad p in the Chad storage hopper 5*a*.

Also, the detection device 9 functions as a range sensor 9*a* and can therefore double as a detecting sensor for the Chad storage hopper 5 because it is determined that the Chad storage hopper 5 is not mounted if the bottom of the Chad storage device 5 cannot be detected.

In this embodiment, closing the front cover 10*a*1 of the paper finisher 10 in the manner shown in FIG. 22A to enable finishing causes the operating part 10*b* to come into contact with the contact part 7*h*, turn the shutter member 7*f* in the clockwise direction, and open the opening 6*a*1 of the Chad guide 6. Opening the front cover 10*a*1 in the manner shown in FIG. 22B to disable finishing causes the operating part 10*b* to separate from the contact part 7*h*, and the shutter member 7*f* to close off the opening 6*a*1 (*5) by the elastic urging force of the elastic urging device. The Chad p scatters into the paper finisher 10 or enters the moving parts of other components if the shutter member 7*f* opens while the Chad storage hopper 5 has not reached a location where the scattering and falling Chad p can be adequately received, or if the shutter member 7*f* is closed off after the Chad storage hopper 5 has moved away from a position where the scattering and falling Chad p can be adequately received. The sensor may thereby give off an abnormality signal, or the paper finisher 10 may develop a malfunction.

In view of this, in the present embodiment, the shutter member 7*f* is set to be opened after the chad receiving inlet of the chad storage hopper 5 has reached a position where the chad p falling from the declining part 6*a*2 of the chad guide 6 can be adequately received, and the shutter member 7*f* is also set to be opened while the chad receiving inlet of the chad storage hopper 5 is disposed in a position where the chad p falling from the declining part 6*a*2 of the chad guide 6 can be adequately received. It is possible to set this type of timing by selecting the relative relationship between the amount by which the operating part 10*b* protrudes and the amount by which the chad storage hopper 5 protrudes from the front cover 10*a*1.

FIG. 22C shows the front cover 10*a*1 as it is being opened, from which it is apparent that the chad storage hopper 5 is still moving to a position capable of receiving the chad p when the shutter member 7*f* has been closed off. Similarly, when the front cover 10*a*1 is closed, the shutter member 7*f* is opened by being pushed further from the position in FIG. 22C, but at this time the chad storage hopper 5 has already reached the position where the chad p can be received.

In this embodiment, the fullness detection sensor and the presence/absence sensor for the chad storage hopper 5*a* are both combined in the range sensor 9*a* as described above, but when the chad p is detected to have filled up the chad storage hopper 5*a* by the range sensor 9*a* and when the front cover 10*a*1 is closed without the chad storage hopper 5*a* being mounted, a signal to this effect is sent toward the main body of the imaging apparatus 50. When the imaging apparatus 50 has received the signal, the imaging operation is stopped in a controlled manner until the aforementioned situation is resolved. Thus, the chad is prevented from scattering into the paper finisher 10, and erroneous operation in the device can be avoided.

In this embodiment, the operating part 10*b* is provided to the front cover 10*a*1 and the shutter member 7*f* is opened and closed according to the opening and closing of the front cover 10*a*1, but the operating part can also be provided integrally with the chad storage hopper 5*a* and similar operations can be performed via the operating part.

Also, in this embodiment, the chad storage hopper 5*a* is detachably mounted to the inner side of the front cover 10*a*1, but the main body frame 0*b* can also be provided with a supporting member and the chad storage hopper 5*a* can be detachably affixed thereto. In this case, the user attaches and removes the chad storage hopper 5*a*, and the opening and closing of the shutter member 7*f* can be coupled with the affixing and removing operation.

According to the embodiments described above, the chad can be prevented from falling or scattering into the apparatus because the opening of the chad guide is closed off.

Also, the chad can be prevented from falling or scattering into the apparatus because the chad can be reliably stored in the chad storage hopper.

Also, the chad can be prevented from falling or scattering into the apparatus because the chad can be prevented from overflowing in the chad storage hopper.

Also, the chad can be prevented from falling or scattering into the apparatus because scuffing is performed to prevent chad from forming when the chad storage hopper is not mounted.

Also, the chad can be prevented from falling or scattering into the apparatus because the chad slides off even when caught on the chad delivery channel shielding member and falls into the chad storage hopper.

Also, sensor or part malfunction can be prevented because the chad can be prevented from falling or scattering into the apparatus.

Furthermore, finishing and imaging can be performed efficiently because sensor or part malfunction can be prevented.

According to the present invention, chad can be reliably prevented from falling or scattering into the apparatus because the shielding member is disposed to be capable of moving back and forth between a chad transportation device and a chad storage device.

Various modifications will become possible for those skilled in the art after receiving the teachings of the present disclosure without departing from the scope thereof.

What is claimed is:

1. A perforator, comprising:

perforating means for perforating a sheet-shaped recording medium;

chad recovery/delivery means for delivering a chad perforated by the perforating means;

chad storage means for storing the chad delivered by the chad recovery/delivery means, and the chad storage means is detachably provided to an inner side of an opening and closing door on a main body of the perforator;

chad guiding means for guiding the chad from the chad recovery/delivery means to the chad storage means via discharge channels;

shielding means including a shielding body and a shielding face fixed on an end of the shielding body, wherein the shielding means is configured to release a shielding operation against the discharge channels to discharge the chad though an opening in an interior of the shielding body to the chad storage means when the shielding means is in a first position; and detection means for detecting whether the chad storage means is mounted on the inner side of the opening and closing door and for detecting an amount of chad stored in the chad storage means, and the detection means is positioned on a bottom edge of the chad guiding means, wherein when the shielding means is in a second position, the shielding face blocks the discharge channels to prevent the chad from being discharged to the chad storage means.

2. The perforator as claimed in claim 1, wherein the shielding means is openably/closably disposed on the discharge channels and prevents the chad from falling to the side of the chad storage means.

3. The perforator as claimed in claim 1, wherein the shielding means begins a shielding release operation after the shielding face opens all the discharge channels.

4. The perforator as claimed in claim 1, wherein the shielding means completes the shielding operation of the discharge channels after the shielding face closes all the discharge channels.

5. The perforator as claimed in claim 1, wherein the shielding means shields the discharge channels when the opening and closing door in the front surface of the perforator main body is open, and opens the discharge channels when the opening and closing door is closed.

6. The perforator as claimed in claim 5, wherein the chad storage means is provided to the opening and closing door on the perforator main body.

7. The perforator as claimed in claim 1, wherein the shielding means is swingably mounted in relation to a fulcrum.

8. The perforator as claimed in claim 7, wherein inclined sliding surfaces are formed on an inner periphery of the opening of the shielding body.

9. The perforator as claimed in claim 7, further comprising elastic means for elastically urging the shielding means in the normally closed direction.

10. The perforator as claimed in claim 1, wherein the chad storage means is detachably provided to the inner side of an opening and closing door of the perforator main body.

11. The perforator as claimed in claim 1, further comprising operating means for performing shielding and shielding release operations for the shielding means in conjunction with an opening/closing operation of the opening and closing door on a front surface of a perforator main body.

12. The perforator as claimed in claim 1, further comprising:

guiding means for guiding the chad delivered by the chad recovery/delivery means to the chad storage means; and separating means for separating the chad from the chad recovery/delivery means and transferring the chad to the guiding means.

13. The perforator as claimed in claim 12, wherein the separating means comprises chad separation accelerating means for accelerating the separation of the chad delivered by the chad recovery/delivery means.

14. The perforator as claimed in claim 1, wherein the shielding face is substantially perpendicular to the shielding body.

15. The perforator as claimed in claim 1, wherein the shielding means includes a detachment part, and when the shielding means is in the second position, the detection means detects the detachment part and determines that the chad storage means is not mounted to the perforator.

16. A paper handler, comprising:

processing means for performing a predetermined process on a sheet-shaped recording medium; and a perforator for perforating the sheet-shaped recording medium, the perforator including perforating means for perforating the recording medium, chad recovery/delivery means for delivering a chad perforated by the perforating means, chad storage means for storing the chad delivered by the chad recovery/delivery means, and the chad storage means is detachably provided to an inner side of an opening and closing door on a main body of the perforator, chad guiding means for guiding the chad from the chad recovery/delivery means to the chad storage means via discharge channels, shielding means including a shielding body and a shielding face fixed on an end of the shielding body, wherein the shielding means is configured to release a shielding operation against the discharge channels to discharge the chad though an opening in an interior of the shielding body to the chad storage means when the shielding means is in a first position, and detection means for detecting whether the chad storage means is mounted on the inner side of the opening and closing door and for detecting an amount of chad stored in the chad storage means, and the detection means is positioned on a bottom edge of the chad guiding means, wherein when the shielding means is in a second position, the shielding face blocks the discharge channels to prevent the chad from being discharged to the chad storage means.

17. The paper handler as claimed in claim 16, wherein the shielding face is substantially perpendicular to the shielding body.

18. The paper handler as claimed in claim 16, wherein the shielding means includes a detachment part, and when the shielding means is in the second position, the detection means detects the detachment part and determines that the chad storage means is not mounted to the paper handler.

19. An imaging apparatus, comprising:

imaging means for forming an image on a recording medium; and a perforator for perforating the recording medium, wherein the perforator includes perforating means for perforating the recording medium, chad recovery/delivery means for delivering a chad perforated by the perforating means, chad storage means for storing the chad delivered by the chad recovery/delivery means, and the chad storage means is detachably provided to an inner side of an opening and closing door on a main body of the perforator, chad guiding means for guiding the chad from the chad recovery/delivery means to the chad storage means via discharge channels, shielding means including a shielding body and a shielding face fixed on an end of the shielding body, wherein the shielding means is configured to release a shielding operation against the discharge channels to discharge the chad though an opening in an interior of the shielding body to the chad storage means when the shielding means is in a first position, and detection means for detecting whether the chad storage means is mounted on the inner side of the opening and closing door and for detecting an amount of chad stored in the chad storage means, and the detection means is positioned on a bottom edge of the chad guiding means, wherein when the shielding means is in a second position, the shielding face blocks the discharge channels to prevent the chad from being discharged to the chad storage means.

20. The imaging apparatus as claimed in claim 19, wherein the shielding face is substantially perpendicular to the shielding body.

21. The imaging apparatus as claimed in claim 19, wherein the shielding means includes a detachment part, and when the shielding means is in the second position, the detection means detects the detachment part and determines that the chad storage means is not mounted to the imaging apparatus.

22. An imaging apparatus, comprising:

imaging means for forming an image on a recording medium; and a paper handler composed of a perforator for perforating the recording medium and processing means for performing a predetermined process on the recording medium, wherein the perforator comprises:

perforating means for perforating the recording medium, chad recovery/delivery means for delivering a chad perforated by the perforating means, chad storage means for storing the chad delivered by the chad recovery/delivery means, and the chad storage means is detachably provided to an inner side of an opening and closing door on a main body of the perforator, chad guiding means for guiding the chad from the chad recovery/delivery means to the chad storage means via discharge channels, shielding means including a shielding body and a shielding face fixed on an end of the shielding body, wherein the shielding means is configured to release a shielding operation against the discharge channels to discharge the chad though an opening in an interior of the shielding body to the chad storage means when the shielding means is in a first position, and detection means for detecting whether the chad storage means is mounted on the inner side of the opening and closing door and for detecting an amount of chad stored in the chad storage means, and the detection means is positioned on a bottom edge of the chad guiding means, wherein when the shielding means is in a second position, the shielding face blocks the discharge channels to prevent the chad from being discharged to the chad storage means.

23. The imaging apparatus as claimed in claim 22, wherein the shielding face is substantially perpendicular to the shielding body.

24. The imaging apparatus as claimed in claim 22, wherein the shielding means includes a detachment part, and when the shielding means is in the second position, the detection means detects the detachment part and determines that the chad storage means is not mounted to the imaging apparatus.

25. A perforator, comprising:

a perforating device configured to perforate a sheet-shaped recording medium;

a chad recovery/delivery device configured to deliver a chad perforated by the perforating device;

a chad storage device configured to store the chad delivered by the chad recovery/delivery device, and the chad storage device is detachably provided to an inner side of an opening and closing door on a main body of the perforator;

a chad guiding device including discharge channels and configured to guide the chad from the chad recovery/delivery device to the chad storage device;

a shielding member including a shielding body and a shielding face fixed on an end of the shielding body, wherein the shielding member is rotatably engaged with the chad guiding device and configured to rotate between a first position and a second position; and a detection device to detect whether the chad storage device is mounted on the inner side of the opening and closing door and to detect an amount of chad stored in the chad storage device, and the detection device is positioned on a bottom edge of the chad guiding device, wherein when the shielding member is in the first position, the shielding member is configured to release a shielding operation against the discharge channels to discharge the chad though an opening in an interior of the shielding body to the chad storage device, and when the shielding member is in the second position, the shielding face is configured to block the discharge channels to prevent the chad from being discharged to the chad storage device.

26. The perforator as claimed in claim 25, wherein the shielding member is swingably mounted in relation to a fulcrum.

27. The perforator as claimed in claim 26, wherein inclined sliding surfaces are formed on an inner periphery of the opening of the shielding body.

28. The perforator as claimed in claim 26, farther comprising elastic means for elastically urging the shielding member in the normally closed direction.

29. The perforator as claimed in claim 25, wherein the chad storage device is detachably provided to an inner side of an opening and closing door of a perforator main body.

30. The perforator as claimed in claim 25, further comprising an operating part configured to perform shielding and shielding release operations for the shielding member in conjunction with an opening/closing operation of an opening and closing door on a front surface of a perforator main body.

31. The perforator as claimed in claim 30, wherein the operating part is provided integrally with the opening and closing door.

32. The perforator as claimed in claim 30, wherein the operating part is provided integrally with the chad storage device.

33. The perforator as claimed in claim 25, wherein the shielding face is substantially perpendicular to the shielding body.

34. The perforator as claimed in claim 25, wherein the shielding member includes a detachment part, and when the shielding member is in the second position, the detection device detects the detachment part and determines that the chad storage device is not mounted to the perforator.

35. A paper handler, comprising:

a processing device configured to perform a predetermined process on a sheet-shaped recording medium; and a perforator configured to perforate the sheet-shaped recording medium, wherein the perforator includes a perforating device configured to perforate the recording medium, a chad recovery/delivery device configured to deliver a chad perforated by the perforating device, a chad storage device configured to store the chad delivered by the chad recovery/delivery device, and the chad storage device is detachably provided to an inner side of an opening and closing door on a main body of the perforator, a chad guiding device including discharge channels and configured to guide the chad from the chad recovery/delivery device to the chad storage device, a shielding member including a shielding body and a shielding face fixed on an end of the shielding body, wherein the shielding member is rotatably engaged with the chad guiding device and configured to rotate between a first position and a second position, and a detection device to detect whether the chad storage device is mounted on the inner side of the opening and closing door and to detect an amount of chad stored in the chad storage device, and the detection device is positioned on a bottom edge of the chad guiding device, wherein when the shielding member is in the first position, the shielding member is configured to release a shielding operation against the discharge channels to discharge the chad though an opening in an interior of the shielding body to the chad storage device, and when the shielding member is in the second position, the shielding face is configured to block the discharge channels to prevent the chad from being discharged to the chad storage device.

36. The paper handler as claimed in claim 35, wherein the shielding face is substantially perpendicular to the shielding body.

37. The paper handler as claimed in claim 35, wherein the shielding member includes a detachment part, and when the shielding member is in the second position, the detection device detects the detachment part and determines that the chad storage device is not mounted to the paper handler.

38. An imaging apparatus, comprising:

an imaging device configured to form an image on a recording medium; and a perforator configured to perforate the recording medium, wherein the perforator includes a perforating device configured to perforate the recording medium, a chad recovery/delivery device configured to deliver a chad perforated by the perforating device, a chad storage device configured to store the chad delivered by the chad recovery/delivery device, and the chad storage device is detachably provided to an inner side of an opening and closing door on a main body of the perforator, a chad guiding device including discharge channels and configured to guide the chad from the chad recovery/delivery device to the chad storage device, a shielding member including a shielding body and a shielding face fixed on an end of the shielding body, wherein the shielding member is rotatably engaged with the chad guiding device and configured to rotate between a first position and a second position, and a detection device to detect whether the chad storage device is mounted on the inner side of the opening and closing door and to detect an amount of chad stored in the chad storage device, and the detection device is positioned on a bottom edge of the chad guiding device, wherein when the shielding member is in the first position, the shielding member is configured to release a shielding operation against the discharge channels to discharge the chad though an opening in an interior of the shielding body to the chad storage device, and when the shielding member is in the second position, the shielding face is configured to block the discharge channels to prevent the chad from being discharged to the chad storage device.

39. The imaging apparatus as claimed in claim 38, wherein the shielding face is substantially perpendicular to the shielding body.

40. The imaging apparatus as claimed in claim 38, wherein the shielding member includes a detachment part, and when the shielding member is in the second position, the detection device detects the detachment part and determines that the chad storage device is not mounted to the imaging apparatus.

41. An imaging apparatus, comprising:

an imaging device configured to form an image on a recording medium; and a paper handler composed of a perforator configured to perforate the recording medium and a processing device configured to perform a predetermined process on the recording medium, wherein the perforator includes a perforating device configured to perforate the recording medium, a chad recovery/delivery device configured to deliver a chad perforated by the perforating device, a chad storage device configured to store the chad delivered by the chad recovery/delivery device, and the chad storage device is detachably provided to an inner side of an opening and closing door on a main body of the perforator, a chad guiding device including discharge channels and configured to guide the chad from the chad recovery/delivery device to the chad storage device, a shielding member including a shielding body and a shielding face fixed on an end of the shielding body, wherein the shielding member is rotatably engaged with the chad guiding device and configured to rotate between a first position and a second position, and a detection device to detect whether the chad storage device is mounted on the inner side of the opening and closing door and to detect an amount of chad stored in the chad storage device, and the detection device is positioned on a bottom edge of the chad guiding device, wherein when the shielding member is in the first position, the shielding member is configured to release a shielding operation against the discharge channels to discharge the chad though an opening in an interior of the shielding body to the chad storage device, and when the shielding member is in the second position, the shielding face is configured to block the discharge channels to prevent the chad from being discharged to the chad storage device.

42. The imaging apparatus as claimed in claim 41, wherein the shielding face is substantially perpendicular to the shielding body.

43. The imaging apparatus as claimed in claim 41, wherein the shielding member includes a detachment part, and when the shielding member is in the second position, the detection device detects the detachment part and determines that the chad storage device is not mounted to the imaging apparatus.

* * * * *